US012577839B2

(12) United States Patent
Zhang et al.

(10) Patent No.: US 12,577,839 B2
(45) Date of Patent: Mar. 17, 2026

(54) DEVICES, SYSTEMS, AND METHODS OF A CUTTING ELEMENT IN A BIT

(71) Applicant: Schlumberger Technology Corporation, Sugar Land, TX (US)

(72) Inventors: Youhe Zhang, Spring, TX (US); Balasubramanian Durairajan, Sugar Land, TX (US); Ryan Mushinski, Sugar Land, TX (US); Huimin Song, Spring, TX (US); Xiaoge Gan, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/768,416

(22) Filed: Jul. 10, 2024

(65) Prior Publication Data

US 2025/0020027 A1 Jan. 16, 2025

Related U.S. Application Data

(60) Provisional application No. 63/512,693, filed on Jul. 10, 2023.

(51) Int. Cl.
*E21B 10/567* (2006.01)
*E21B 10/43* (2006.01)

(52) U.S. Cl.
CPC ..... *E21B 10/5673* (2013.01); *E21B 10/43* (2013.01); *E21B 10/5676* (2013.01)

(58) Field of Classification Search
CPC ... E21B 10/5673; E21B 10/5676; E21B 10/43
See application file for complete search history.

(56) References Cited

U.S. PATENT DOCUMENTS

| | | | | |
|---|---|---|---|---|
| 5,078,219 | A * | 1/1992 | Morrell | E21B 10/44 299/111 |
| 6,123,161 | A * | 9/2000 | Taylor | E21B 10/55 175/397 |
| 6,408,958 | B1 | 6/2002 | Isbell | |
| 9,359,825 | B2 * | 6/2016 | Gavia | E21B 10/43 |
| 9,500,070 | B2 * | 11/2016 | DiGiovanni | E21B 10/50 |
| 9,598,909 | B2 * | 3/2017 | Patel | E21B 10/52 |
| 10,914,124 | B2 * | 2/2021 | Borge | C22C 26/00 |
| 11,578,538 | B2 * | 2/2023 | Mahajan | E21B 10/5673 |
| 2004/0163851 | A1 * | 8/2004 | McDonough | E21B 10/52 175/426 |
| 2007/0205023 | A1 | 9/2007 | Hoffmaster | |
| 2008/0264696 | A1 * | 10/2008 | Dourfaye | E21B 10/573 175/428 |
| 2011/0192651 | A1 | 8/2011 | Lyons | |
| 2019/0106943 | A1 | 4/2019 | Tilleman | |
| 2019/0376346 | A1 * | 12/2019 | Vijayabalan | E21B 10/46 |
| 2020/0032589 | A1 * | 1/2020 | Izbinski | E21B 10/5735 |
| 2021/0180409 | A1 * | 6/2021 | Davila | E21B 10/5735 |
| 2022/0251905 | A1 | 8/2022 | Duffy | |
| 2024/0110447 | A1 * | 4/2024 | Chen | E21B 10/43 |

* cited by examiner

*Primary Examiner* — Blake Michener
(74) *Attorney, Agent, or Firm* — Jeffrey D. Frantz

(57) ABSTRACT

A cutting element may include a substrate having a base. A cutting element may include an ultrahard layer bonded to the substrate, the ultrahard layer formed from an ultrahard material, the ultrahard layer including: a side surface adjacent to the base, the side surface including a plurality of cutting surfaces; and an upper surface extending into the ultrahard layer.

19 Claims, 17 Drawing Sheets

DEVICES, SYSTEMS, AND METHODS OF A CUTTING ELEMENT IN A BIT

CROSS-REFERENCE TO RELATED APPLICATIONS

This application claims priority to, and the benefit of U.S. Patent Application No. 63/512,693, filed Jul. 10, 2023, which is expressly incorporated herein by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores. An earth-boring tool may include one or more cutting elements secured to a blade of the tool. Typically, the tool includes one or more cutter pockets on an outer surface of the tool body, and the cutting elements are secured within the pockets by brazing.

SUMMARY

In some aspects, the techniques described herein relate to a cutting element. The cutting element includes a substrate having a base. An ultrahard layer is bonded to the substrate. The ultrahard layer is formed from an ultrahard material. The ultrahard layer includes a side surface adjacent to the base. The side surface includes a plurality of cutting surfaces. An upper surface is recessed into the ultrahard layer. In some embodiments, the cutting element is secured to a bit.

In some aspects, the techniques described herein relate to a method for manufacturing a bit. The method includes forming a faceted cutting element pocket in a blade of a bit. A cutting element is inserted into the faceted cutting element pocket. The cutting element is complementary to the faceted cutting element pocket. The cutting element includes a plurality of cutting surfaces on a side surface of the cutting element. The cutting element is oriented so that one of the plurality of cutting surfaces is oriented in a cutting direction of the bit. The cutting element is secured to the faceted cutting element pocket. In some embodiments, the faceted cutting element is located as a backup cutting element rotationally behind a primary cutting element. In some embodiments, the faceted cutting element is located at the leading edge of the blade as a primary cutting element. In some embodiments, a blade and/or a bit may include both primary and backup faceted cutting element. In some embodiments, the tip of the forward-facing cutting surface has the same exposure as the primary cutting element and/or the main cutting profile. In some embodiments, the tip of the forward-facing cutting surface has a lower exposure than the primary cutting element and/or the main cutting profile.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a representation of a bottom view of a bit, according to at least one embodiment of the present disclosure;

FIG. 2-2 is a representation of the bit of FIG. 2-1 having faceted cutting elements secured to faceted cutting element pockets;

FIG. 2-3 is a representation of a cross-sectional view of the blade illustrated in FIG. 2-2;

FIG. 2-4 is a representation of a cross-sectional view of the blade illustrated in FIG. 2-2;

FIG. 3-1 is a perspective view of a representation of a faceted cutting element, according to at least one embodiment of the present disclosure;

FIG. 3-2 is a representation of a bevel of the faceted cutting element of FIG. 3-1;

FIG. 4 is a representation of a side-view of a faceted cutting element, according to at least one embodiment of the present disclosure;

FIG. 8-1 and FIG. 8-2 are representations of a cutting element engaging a rock formation, according to at least one embodiment of the present disclosure;

FIG. 9-1 and FIG. 9-2 are representations of cutting element profiles, according to at least one embodiment of the present disclosure;

DETAILED DESCRIPTION

Figure 1:
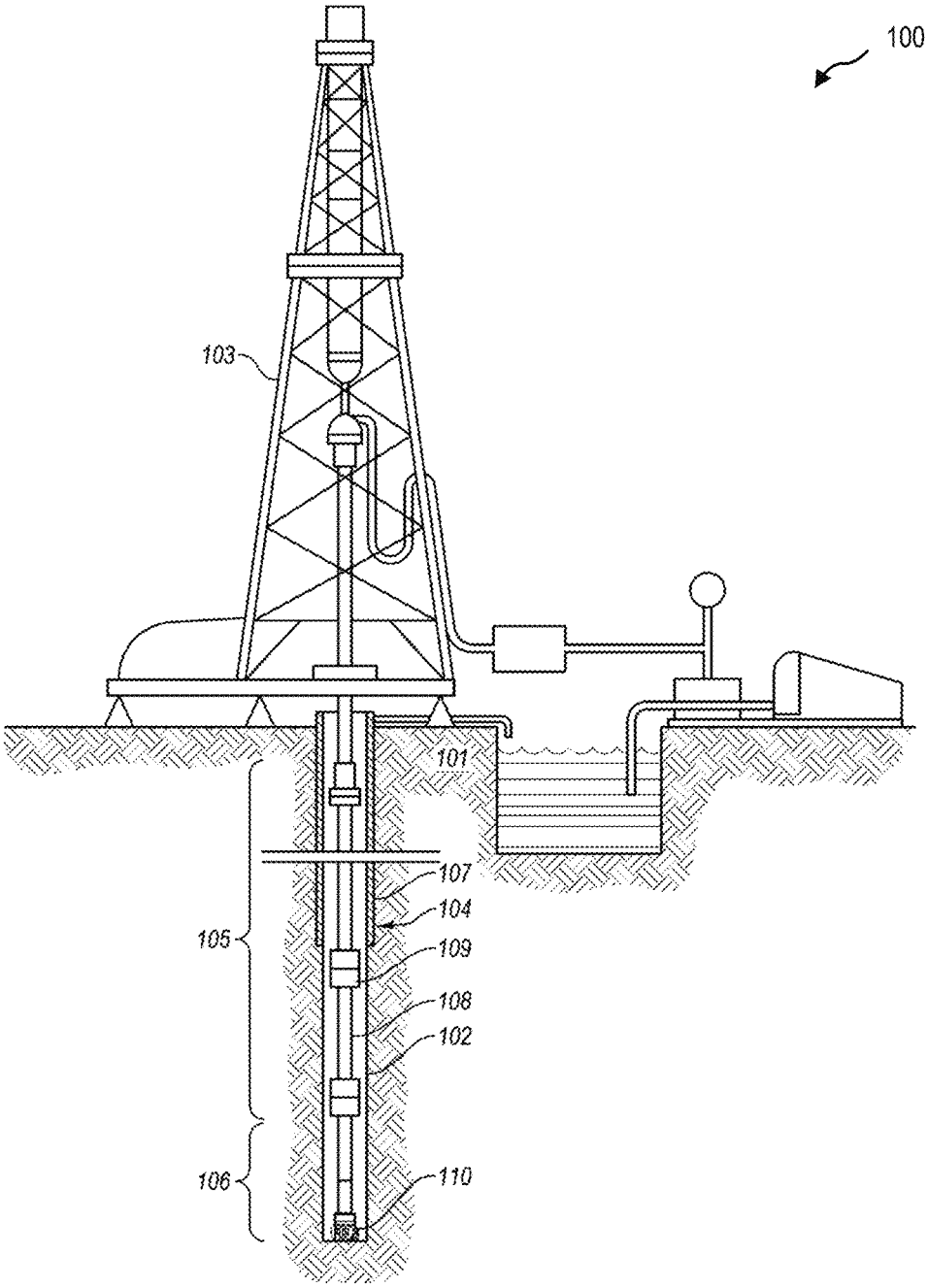
FIG. 1 shows one example of a drilling system for drilling an earth formation to form a wellbore, according to at least one embodiment of the present disclosure.

This disclosure generally relates to devices, systems, and methods for a faceted cutting element. A cutting element includes a substrate with an ultrahard layer bonded to an upper surface of the substrate. The ultrahard layer is typically formed into a shape based on the function of the cutting element. For example, a scraping cutting element typically includes a flat cutting surface that is parallel or approximately parallel to the substrate and/or the base of the cutting element. In some examples, the ultrahard layer has a conical, frustoconical, or domed surface. This may help to facilitate crushing of the rock and/or as depth-of-cut control to reduce blade wear. But these cutting elements do not efficiently engage the formation with a scraping motion. In accordance with at least one embodiment of the present disclosure, a faceted cutting element may include multiple cutting faces oriented around a side surface of the cutting element. The cutting faces may engage the formation with a scraping cutting motion.

Conventionally, to install a cutting element in a bit, a cutting element pocket is formed in the bit. For primary cutting elements, the cutting element pocket may be drilled into the leading edge of a blade of the bit. For a secondary cutting element, the cutting element pocket may be formed in the outer surface of the blade, rotationally behind the primary cutting element. In some situations, to install a backup cutting element rotationally behind the primary cutting element, a rectangular cutting element pocket may be milled into the outer surface and a cutting element having a cutting surface facing the rotational direction of the blade may be secured to the rectangular cutting element pocket. The secondary cutting element (or backup cutting element) may be installed with a curved side located in the bottom of the cutting element pocket. Milling the rectangular cutting element pocket for the backup cutting element is time consuming, resulting in increased costs to manufacture the bit. Further, milling the backup rectangular cutting element pocket may place adjacent cutting element pockets close to each other. This may increase the stresses in the blade material between the adjacent cutting element pockets, thereby increasing the likelihood of cracks and/or fractures in the blade material between the adjacent cutting element pockets. In some situations, the base of a cutting element pocket may break through to an adjacent cutting element pocket. This may reduce the strength of the connection between the blade and the cutting element. In some situations, the backup rectangular cutting element pocket may have a shape that is not complementary to the inserted cutting element, causing the rectangular cutting element pocket to be filled with a filler material, which may reduce the strength of the connection with the cutting element.

In accordance with at least one embodiment of the present disclosure, the cutting element pocket may be drilled into the outer surface of the blade. This may form a cylindrical cutting element pocket. The faceted cutting element may include a cylindrical substrate base that may have a complementary shape to the cylindrical cutting element pocket. An ultrahard layer may be joined to the substrate. A cutting element axis extends through the substrate base and the ultrahard layer. The ultrahard layer may include a plurality of cutting surfaces arranged around the cutting element axis. The upper surface of the ultrahard layer radially interior to the cutting surfaces may be recessed. In some embodiments, the cutting surfaces near the upper surface are inclined toward the cutting element axis. In some embodiments, the upper surface may be recessed across the cutting element axis of the cutting element. The plurality of cutting surfaces may extend across the depth of the ultrahard layer and an upper portion of the substrate. One of the cutting surfaces may face a direction of rotation of the bit and be configured to engage the formation with a scraping motion. In this manner, the cutting element may be more easily installed in the blade of the bit, thereby reducing the time and cost to assemble the bit. In some embodiments, the cutting surface of a faceted cutting element that is facing the direction of rotation and in a backup arrangement may have the same exposure as a leading cutting element in the same or adjacent radial position about a bit axis.

In accordance with at least one embodiment of the present disclosure, the faceted cutting element may be oriented such that an edge between two adjacent cutting faces may be facing the rotational direction of the bit. This may cause the edge to engage the formation. Causing the edge between two adjacent cutting formations to engage the formation may increase the cutting efficiency of the faceted cutting element.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

In accordance with at least one embodiment of the present disclosure, the bit 110 may include one or more cutting elements inserted into an outer surface of the bit 110. One of the cutting elements may include a cylindrical base and an ultrahard layer bonded to the cylindrical base. The ultrahard layer may include a plurality of cutting surfaces on a side surface thereof. To secure the cutting element to the bit, the cutting element may be inserted into a faceted cutting element pocket. The cutting element may be oriented so that one of the cutting surfaces is facing a direction of rotation of the bit 110. In this manner, the cutting element may engage the formation as the bit 110 is rotated. In some embodiments, the cutting element may be an active cutting element configured to engage with the formation rather than a passive cutting element configured to provide depth of cut control or to reduce wear of the surrounding bit material. In some embodiments, the cutting element may be oriented so that an edge between two adjacent cutting surfaces may be oriented in the direction of rotation of the bit 110. As discussed in further detail herein, securing the cutting element to the faceted cutting element pocket may increase the strength of the connection between the cutting element and the bit.

Figures 1, 2:
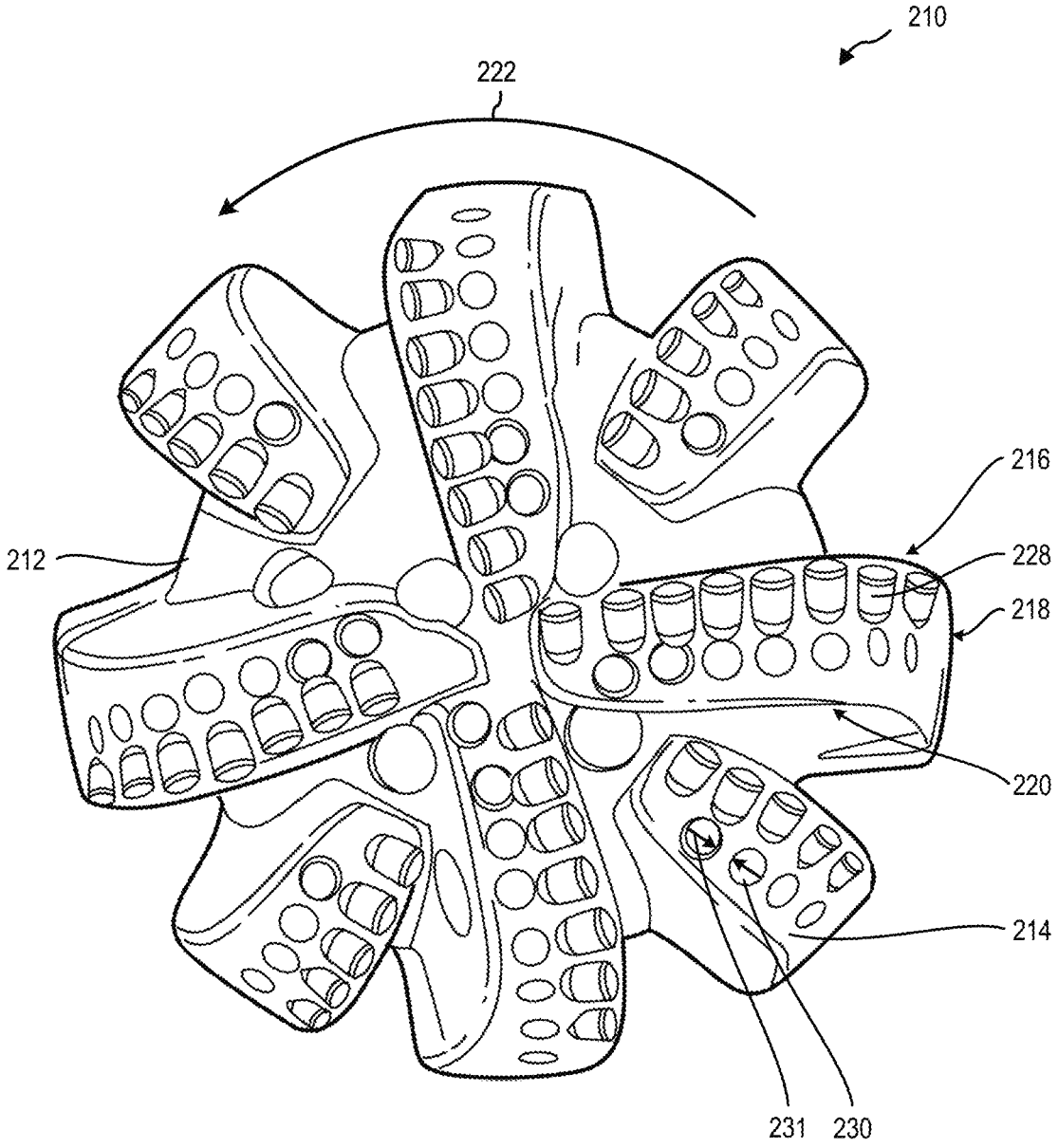
Figure 2:
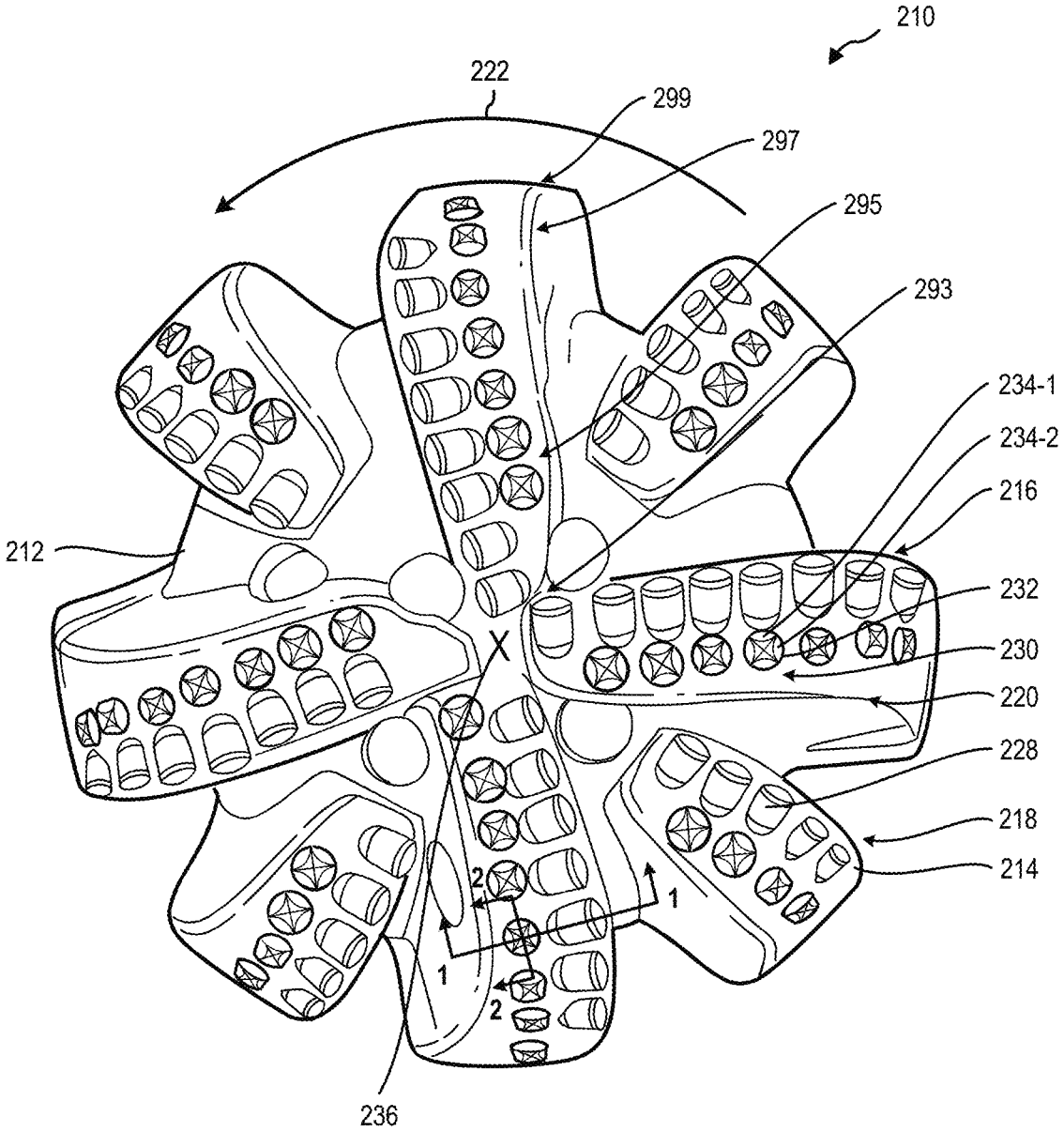

FIG. 2-1 is a perspective view of the downhole end of an embodiment of a bit 210. The bit 210 may include a bit body 212 from which a plurality of blades 214 may protrude. At least one of the blades 214 may have a plurality of cutting elements connected thereto. In some embodiments, at least one of the cutting elements may be a planar cutting element, such as a shear cutting element. In other embodiments, at least one of the cutting elements may be a non-planar cutting element, such as a conical cutting element or a ridged cutting element.

The blade 214 includes a leading surface 216, an outer surface 218, and a trailing surface 220. The leading surface 216 may face forward in a rotational direction 222 of the bit 210. As the bit 210 rotates in the rotational direction 222, the leading surface 216 may encounter and/or pass by features of the formation before the outer surface 218 and/or a trailing surface 220. The outer surface 218 may face rearward in the rotational direction 222 of the bit 210. For example, as the bit 210 rotates in the rotational direction 222, the trailing surface 220 may pass by features of the formation after the leading surface 216 and/or the outer surface 218.

The outer surface 218 may be a surface of the blade 214 facing the formation. For example, the outer surface 218 may be a radially outer surface of the blade 214 (such as in a gauge region 299 of the bit 210). In some examples, the outer surface 218 may be a longitudinally outer surface of the blade (such as in a nose region 295 of the bit 210). In some embodiments, the outer surface 218 may be the surface of the blade 214 that is located furthest away from the bit body 212 at any particular point of the bit 210.

In the embodiment shown, the blade 214 includes a primary cutting element 228. The primary cutting element 228 may be located on the leading surface 216 of the blade 214. The primary cutting element 228 may have a cutting surface that is oriented in the direction of the leading surface 216. As the bit 210 rotates in the rotational direction 222, the primary cutting element 228 may engage the formation, which may remove at least a portion of the formation.

The bit 210 shown in FIG. 2-1 includes a plurality of faceted cutting element pockets 230. In the embodiment shown, the faceted cutting element pockets 230 do not include any cutting element inserted into any of the faceted cutting element pockets 230. The faceted cutting element pockets 230 are installed in the outer surface 218 of the blade 214.

In some embodiments, to install a faceted cutting element pocket 230, a drill may engage the outer surface 218 of the blade 214 with a drill bit. The drill bit may penetrate into the blade 214. For example, the drill bit may penetrate into the blade 214 along a pocket axis. This may cause a cylindrical pocket to be drilled into the outer surface 218 of the blade 214. As discussed herein, a conventional cutting element pocket at the outer surface 218 of the blade 214 may be milled into the blade 214 to form a rectangular shape whereby the machine tool moves along the blade while penetrating the blade to form the rectangular shape, which may take significant time and expense. Forming a faceted cutting element pocket 230 may be less time and resource intensive, thereby reducing the cost of forming the faceted cutting element pockets 230 and the bit 210.

In some embodiments, forming the faceted cutting element pockets 230 may help to increase a pocket distance 231 between adjacent faceted cutting element pockets 230. Increasing the pocket distance 231 between adjacent faceted cutting element pockets 230 may help to reduce the stresses on the material of the blade 214 in the space between adjacent faceted cutting element pockets 230. In some embodiments, increasing the pocket distance 231 may help to reduce or prevent the chance for adjacent faceted cutting element pockets 230 to intersect. When cutting elements are installed in the faceted cutting element pockets 230, an increased pocket distance 231 may help to reduce or prevent damage to the material of the blade 214. This may help to reduce or prevent the cutting elements from becoming dislodged from the blade 214.

In FIG. 2-2, a faceted cutting element 232 may be secured to the blade 214 at the outer surface 218 in one of the faceted cutting element pockets 230. The faceted cutting element 232 may have a cylindrical shape that is complementary to the faceted cutting element pocket 230. The faceted cutting element 232 may be secured to the faceted cutting element pockets 230 in any manner. For example, the faceted cutting element 232 may be secured to the faceted cutting element pockets 230 by braze, weld, press fit, mechanical fastener, any other connection mechanism, and combinations thereof.

The bit 210 includes a cone region 293, a nose region 295, a shoulder region 297, and a gauge region 299. In some embodiments, the faceted cutting element 232 may be secured to the blade 214 at any portion of the bit 210. For example, the faceted cutting element 232 may be secured to the blade 214 at the cone region 293. In some examples, the faceted cutting element 232 may be secured to the blade 214 at the nose region 295. In some examples, the faceted cutting element 232 may be secured to the blade at the shoulder region 297. In some examples, the faceted cutting element 232 may be secured to the blade 214 at the gauge region 299.

The faceted cutting element 232 may include a plurality of cutting surfaces (collectively 234). The cutting surfaces 234 may be located on a side surface of the faceted cutting element 232. In some embodiments, at least one of the cutting surfaces 234 may be oriented in a cutting direction of the bit 210. A cutting direction may be any direction in which the cutting surfaces 234 may experience cutting forces with the formation. For example, a cutting direction may include the rotational direction 222 (e.g., forward direction). In some examples, a cutting direction may include a lateral direction (e.g., due to lateral motion of the bit 210 during drilling activities).

In some embodiments, an edge between two of the cutting surfaces 234 may be oriented in the cutting direction of the bit 210. Orienting the edge in the cutting direction of the bit may help to improve the cutting efficiency of the faceted cutting element 232.

In some embodiments, a forward cutting surface 234-1 may be oriented toward the leading surface 216 of the blade 214. As the bit 210 rotates in the rotational direction 222, the forward cutting surface 234-1 may be oriented to engage the formation. In the embodiment shown, the faceted cutting element 232 may be a backup cutting element on the blade 214. The faceted cutting element 232 may be located rotationally behind one or more primary cutting elements 228 of the blade 214. For example, the faceted cutting element 232 may be located on the outer surface 218 between the leading surface 216 and the trailing surface 220. In some examples, the faceted cutting element 232 may be located closer to the trailing surface 220 than at least a portion of one of the primary cutting elements 228. As the bit 210 rotates in the rotational direction 222, the forward cutting surface 234-1 of the backup faceted cutting element 232 may engage the formation in the same path or an overlapping path as the primary cutting element 228. In some embodiments, the forward cutting surface 234-1 of the faceted cutting element 232 may be on profile of the primary cutting element 228. In this manner, the forward cutting surface 234-1 of the faceted cutting element 232 may be a backup cutting element for the primary cutting element 228. In some embodiments, the forward cutting surface 234-1 may be off profile of the primary cutting element 228. In this manner, the forward cutting surface 234-1 may be a backup cutting element to the primary cutting element 228 and help to clean up the formation from the cutting of the primary cutting element 228. An off profile faceted cutting element 232 may be configured as a depth-of-cut control element to limit the depth of cut on the primary cutting element in the leading position. The faceted cutting element 232 may more efficiently engage the formation and remove the formation in an off profile arrangement than a domed back up depth-of-cut insert in the backup position.

In some embodiments, the faceted cutting element 232 may include one or more adjacent cutting surfaces 234-2 that are adjacent to the forward cutting surface 234-1. For example, the adjacent cutting surfaces 234-2 may engage the formation based on lateral motion of the bit 210. During drilling activities, the bit 210 may rotate in the rotational direction 222 about a rotational axis 236. In some situations, the bit 210 may rotate eccentrically. For example, the rotational axis 236 may move in the wellbore. This may cause lateral motion of the bit 210. In accordance with at least one embodiment of the present disclosure, when the bit 210 experiences lateral motion during rotation, the adjacent cutting surfaces 234-2 may engage the formation during the lateral motion. Such lateral engagement may help to reduce the wear and tear on the faceted cutting element 232 and/or the primary cutting element 228.

In some embodiments, the cutting surfaces 234 may be located on an opposite end of the faceted cutting element 232 than a base 252 of the faceted cutting element 232. As discussed herein, the cutting surfaces 234 may be oriented with an angle relative to the base 252 of the faceted cutting element 232. For example, as discussed herein, the angle between the cutting surfaces 234 and the base 252 may be less than 90°. The cutting surfaces 234 are not parallel to the side surface 254 of the faceted cutting element 232. In some embodiments, the cutting surfaces 234 are not parallel to a central axis of the faceted cutting element 232. The cutting surfaces 234 may allow one or more of the cutting surfaces 234 to engage the formation during drilling activities.

In accordance with at least one embodiment of the present disclosure, a cutting element axis 263 may extend through a center of the faceted cutting element 232. The cutting element axis 263 may be located in a center of the faceted cutting element 232. In some embodiments, the cutting element axis 263 may be oriented perpendicular to the base 252. In some embodiments, the cutting element axis 263 may be oriented parallel to a sidewall of the base 252. In some embodiments, the cutting element axis 263 may extend through a center of area of the base 252 and a center of area of the upper surface 258 of the ultrahard layer 246. In accordance with at least one embodiment of the present disclosure, the cutting surfaces 234 of the faceted cutting element 232 may extend inward toward the cutting element axis 263. In some embodiments, the plane of each of the cutting surfaces 234, extended past an edge of the cutting surfaces 234, may intersect the cutting element axis 263. In some embodiments, the plane of the cutting surfaces 234, when extended past the edge of the cutting surfaces 234, may intersect the cutting element axis 263 above the upper surface 258 of the ultrahard layer 246.

In some embodiments, the cutting surfaces 234 may intersect the cutting element axis 263 with a cutting surface angle 265. In some embodiments, the cutting surface angle 265 may be in a range having an upper value, a lower value, or upper and lower values including any of 0°, 1°, 2°, 4°, 10°, 15°, 20°, 25°, 30°, 35°, 40°, or 45°, or any value therebetween. For example, the cutting surface angle 265 may be greater than 0°. In another example, the cutting surface angle 265 may be less than 45°. In yet other examples, the cutting surface angle 265 may be any value in a range between 0° and 10°. In some embodiments, it may be critical that the cutting surface angle 265 is between 5° and 20° to effectively cut a particular rock formation.

One or more faceted cutting elements 232 may be secured to the blade 214 at any portion of the blade 214. For example, the faceted cutting elements 232 may be secured to the blade 214 in the nose region, the gauge region, a cone region, any other portion of the blade 214, and combinations thereof.

In some embodiments, the faceted cutting elements 232 may be secured to one of the blades 214 of the bit 210. In some embodiments, the faceted cutting elements 232 may be secured to multiple blades 214 of the bit 210, or to each of the blades 214 of the bit 210.

In the embodiment shown, the faceted cutting elements 232 are backup cutting elements to the primary cutting elements 228. However, it should be understood that the faceted cutting elements 232 may be located on the blade 214 to be a primary cutting element. In some embodiments, a blade 214 may include one or more faceted cutting elements 232 that are primary cutting elements and one or more faceted cutting elements 232 that are backup cutting elements.

Figures 2, 3:
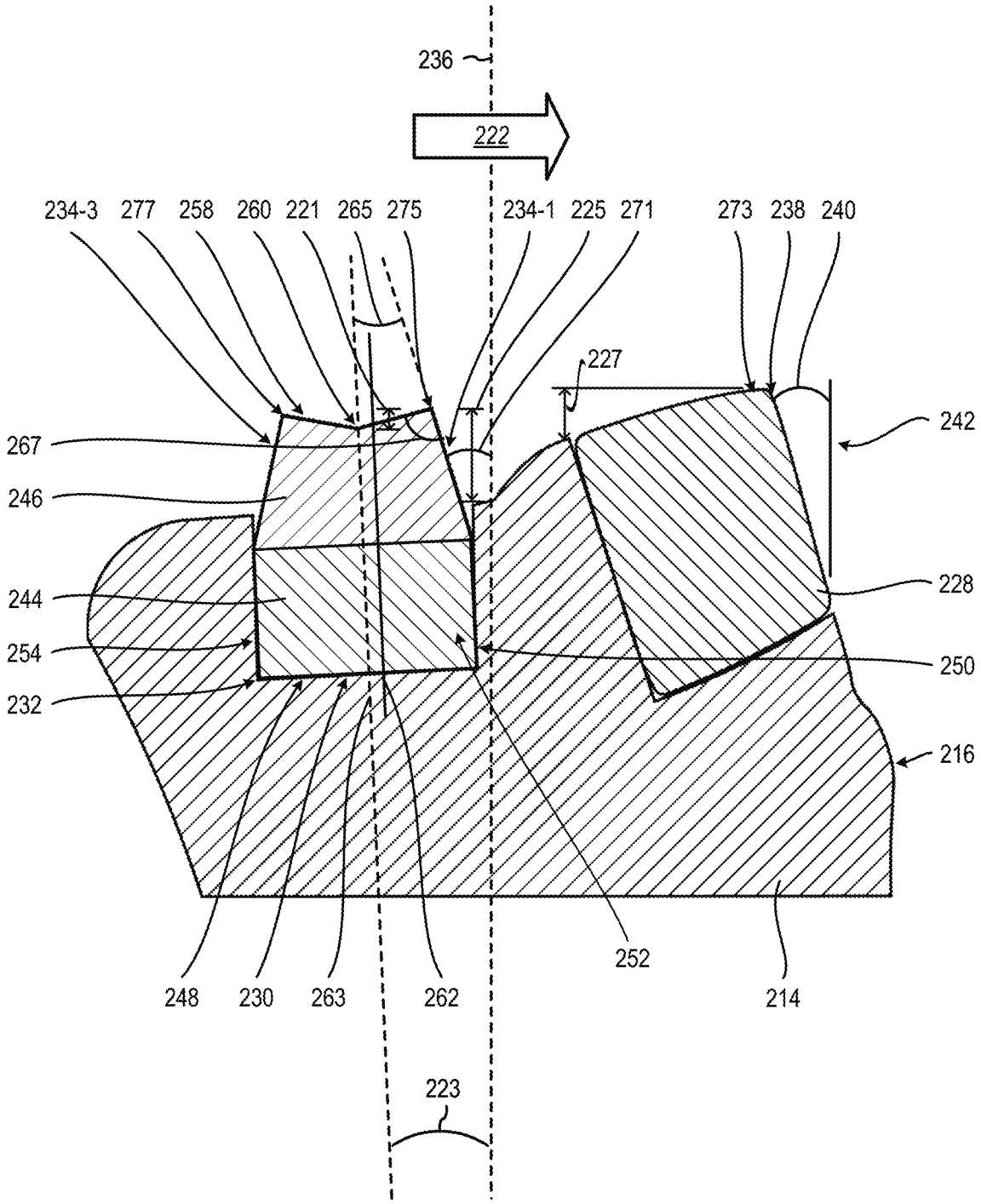

FIG. 2-3 is a cross-sectional view of the blade 214, faceted cutting element 232, and primary cutting element 228 of the bit 210 and along the line 1-1 in FIG. 2-2. The primary cutting element 228 includes a primary cutting surface 238. As discussed herein, the primary cutting surface 238 of the primary cutting element 228 may be oriented to face forward with respect to the rotational direction 222. In the embodiment shown, the primary cutting surface 238 may be oriented to face the same direction as the leading surface 216 of the blade 214.

The primary cutting surface 238 has a primary rake angle 240. The primary rake angle 240 may be the angle between the primary cutting surface 238 and a vertical line 242 parallel to the rotational axis 236 of the bit 210. In some embodiments, the primary rake angle 240 may be in a range having an upper value, a lower value, or upper and lower values including any of −20°, −15°, −10°, −5°, −2°, −1°, 0°, 1°, 2°, 4°, 10°, 15°, 20°, 25°, 30°, or any value therebetween. For example, the primary rake angle 240 may be greater than −20°. In another example, the primary rake angle 240 may be less than 30°. In yet other examples, the primary rake angle 240 may be any value in a range between −10° and 30°. In some embodiments, it may be critical that the primary rake angle 240 is between −10° and 25° to effectively cut a particular rock formation.

The faceted cutting element 232 includes a substrate 244 and an ultrahard layer 246 bonded to the substrate 244. The substrate 244 may be inserted into the faceted cutting element pocket 230. The faceted cutting element 232 may be secured to the blade 214. For example, the substrate 244 may be brazed or otherwise secured to the blade 214. In some embodiments, only the substrate 244 may be brazed or otherwise secured to the blade 214. For example, no portion of the ultrahard layer 246 may be located in the faceted cutting element pocket 230. In some embodiments, no portion of the ultrahard material of the ultrahard layer 246 may be located in the faceted cutting element pocket 230. In some embodiments, the ultrahard layer could be located into the pocket 230.

The faceted cutting element pocket 230 includes a pocket base 248. The pocket base 248 may be the base surface of the faceted cutting element pockets 230 that is extended into the body of the blade 214. In some embodiments, as discussed herein, the pocket base 248 may have a circular shape or a circular cross-sectional shape. The faceted cutting element pocket 230 includes a sidewall 250. The sidewall 250 may be adjacent to the pocket base 248. The faceted cutting element pockets 230 may include a single sidewall 250 that has a circular cross-sectional shape. As may be seen, the circular pocket base 248 and the sidewall 250 having a circular cross-sectional shape may form a cylindrical shape for the faceted cutting element pockets 230.

In some embodiments, the ultrahard layer 246 may be formed from an ultrahard material. The ultrahard layer 246 may be formed from any ultrahard material, such as Polycrystalline diamond (PCD), sapphire, moissanite, hexagonal diamond (Lonsdaleite), tungsten carbide, cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)), any other ultrahard material, and combinations thereof. In some embodiments, the cutting surface 234 may be composed of the ultrahard layer 246 and the substrate 244.

In some embodiments, the cutting surfaces 234 may be formed on the ultrahard layer 246 when the ultrahard material is formed (e.g., pressed). In some embodiments, the cutting surfaces 234 may be formed on the ultrahard layer 246 after the ultrahard material has been formed, such as by grinding the ultrahard layer 246, laser ablating the ultrahard layer 246, otherwise removing the ultrahard material from the ultrahard layer 246, and combinations thereof. In some embodiments, as discussed in further detail herein, the cutting surface 234 may be formed of both the ultrahard layer 246 and the substrate 244.

The ultrahard layer 246 may be bonded to the substrate 244. For example, the ultrahard layer 246 may be bonded to the substrate 244 in any manner, such as by braze, mechanical connection, high temperature and high pressure (HTHP) sintering, any other connection, and combinations thereof. The substrate 244 may have a cylindrical shape that is complementary to the faceted cutting element pockets 230. For example, the substrate 244 may include a base 252. The base 252 may have a circular cross-sectional shape. The base 252 may have a circular shape that is the same size or approximately the same size as the pocket base 248. When the faceted cutting element 232 is inserted into the faceted cutting element pocket 230, the base 252 may contact or otherwise engage with the faceted cutting element pockets 230. Because the base 252 and the pocket base 248 have approximately the same size, the brazed connection between the faceted cutting element 232 and the faceted cutting element pockets 230 may be strengthened because the amount of material used to fill the space between the faceted cutting element pockets 230 and the faceted cutting element 232 may be reduced.

The faceted cutting element 232 includes a side surface 254 that is adjacent to the base 252 of the faceted cutting element 232. The side surface 254 may have the same or similar shape as the base 252. The side surface 254 may extend up the substrate 244 and the ultrahard layer 246.

The cutting surfaces 234 have a facet rake angle 271 with respect to the rotational axis 236 of the bit 210. In some embodiments, the facet rake angle 271 may be the same as the cutting surface angle 265. For example, the cutting element axis 263 may be parallel to the bit axis 236. In some embodiments, the facet rake angle 271 may be different than the cutting surface angle 265. For example, the cutting element axis 263 may have an axis angle 223 with respect to the bit axis 236. In some embodiments, the axis angle 223 may be in a range having an upper value, a lower value, or upper and lower values including any of 0°, 1°, 2°, 4°, 5°, 10°, 15°, 20°, or any value therebetween. For example, the axis angle 223 may be greater than 0. In another example, the axis angle 223 may be less than 2°. In yet other examples, the axis angle 223 may be any value in a range between 0° and 20°. In some embodiments, it may be critical that the axis angle 223 is between 0 and 10° to effectively cut a particular rock formation. The axis angle 223 may impact the difference between the facet rake angle 271 and the cutting surface angle 265. In some embodiments, the axis angle 223 may impact the relative heights of the forward facet tip 275 and the rearward facet tip 277. For example, a larger axis angle 223 may increase the relative exposure between the forward facet tip 275 and the rearward facet tip 277.

In some embodiments, the facet rake angle 271 may be in a range having an upper value, a lower value, or upper and lower values including any of −15°, −10°, −5°, −2°, −1°, 0°, 1°, 2°, 4°, 10°, 15°, 20°, 25°, or any value therebetween. For example, the facet rake angle 271 may be greater than −15°. In another example, the facet rake angle 271 may be less than 25°. In yet other examples, the facet rake angle 271 may be any value in a range between −10° and 10°. In some embodiments, it may be critical that the facet rake angle 271 is between −10° and 10° to effectively cut a particular rock formation.

In some embodiments, the cutting surface angle 265 of the forward cutting surface 234-1 may be the same as the primary rake angle 240. This may allow the forward cutting surface 234-1 to effectively engage the formation as a backup or secondary cutting element to the primary cutting element 228. In some embodiments, the cutting surface angle 265 may be different than the primary rake angle 240. For example, the cutting surface angle 265 may be greater than the primary rake angle 240. In some examples, the cutting surface angle 265 may be less than the primary rake angle 240. A different rake angle between the primary cutting element 228 and the faceted cutting element 232 may allow the primary cutting element 228 and the faceted cutting element 232 to have different cutting profiles and/or different cutting properties.

As discussed herein, the faceted cutting element 232 may be a backup cutting element to the primary cutting element 228. The primary cutting element 228 includes a primary tip 273 and the forward cutting surface 234-1 of the faceted cutting element 232 includes a forward facet tip 275. The primary tip 273 and the forward facet tip 275 have an exposure. The primary exposure 227 of the primary tip 273 may be the amount that the primary tip 273 extends relative to the outer surface 218 of the bit 210. The facet exposure 225 of the forward facet tip 275 may be the amount that the forward facet tip 275 extends relative to the outer surface 218 of the bit 210. A higher exposure may result in an increased cutting load on a cutting element, and a lower exposure may result in a decreased cutting load on a cutting element.

The primary tip 273 and the forward facet tip 275 may have the same exposure. For example, the primary tip 273 and the forward facet tip 275 may extend the same amount relative to the outer surface 218 of the bit. In some embodiments, the primary tip 273 and the forward facet tip 275 may have different exposures. For example, the primary tip 273 may have a greater primary exposure 227 than a facet exposure 225 of the forward facet tip 275. In some embodiments, an exposure difference between the primary exposure 227 of the primary tip 273 and the facet exposure 225 of the forward facet tip 275 (e.g., primary exposure 227 of the primary tip 273 minus the facet exposure 225 of the forward facet tip 275) may be in a range having an upper value, a lower value, or upper and lower values including any of −0.05 in. (−1.27 mm), −0.04 in. (−1.02 mm), −0.03 in. (−0.76 mm), −0.02 in. (−0.51 mm), −0.01 in. (−0.25 mm), 0 in. (0 mm), 0.01 in. (0.25 mm), 0.02 in. (0.51 mm), 0.03 in. (0.76 mm), 0.04 in. (1.02 mm), 0.05 in. (1.27 mm), 0.1 in. (2.5 mm), 0.15 in. (3.8 mm), 0.2 in. (5.1 mm), 0.25 in. (6.4 mm) or any value therebetween. For example, the exposure difference may be greater than −0.05 in. (−1.27 mm). In another example, the exposure difference may be less than 0.25 in. (6.4 mm). In yet other examples, the exposure difference may be any value in a range between −0.05 in. (−1.27 mm) and 0.25 in. (6.4 mm). In some embodiments, it may be critical that the exposure difference is between 0 in. (0 mm) and 0.05 in. (1.27 mm) to help the faceted cutting element 232 to operate as a backup cutting element to the primary cutting element 228.

In some embodiments, a rearward facet tip 277 of the trailing cutting surface 234-3 may have a different exposure than the forward facet tip 275 and/or the primary tip 273. In some examples, the different exposure may be a result of an angle between the cutting element axis 263 and the rotational axis 236. For example, the height of the forward facet tip 275 above the base 252 may be the same as or approximately the same as the height of the rearward facet tip 277 above the base 252. In some examples, the exposure of the forward facet tip 275 may be the same as the exposure of the rearward facet tip 277. In some embodiments, a facet exposure difference in the exposure between the forward facet tip 275 and the rearward facet tip 277 (e.g., exposure of the forward facet tip 275 minus the exposure of the rearward facet tip 277) may be in a range having an upper value, a lower value, or upper and lower values including any of −0.05 in. (−1.27 mm), −0.04 in. (−1.02 mm), −0.03 in. (−0.76 mm), −0.02 in. (−0.51 mm), −0.01 in. (−0.25 mm), 0 in. (0 mm), 0.01 in. (0.25 mm), 0.02 in. (0.51 mm), 0.03 in. (0.76 mm), 0.04 in. (1.02 mm), 0.05 in. (1.27 mm), 0.1 in. (2.5 mm), 0.15 in. (3.8 mm), 0.2 in. (5.1 mm), 0.25 in. (6.4 mm) or any value therebetween. For example, the facet exposure difference may be greater than −0.05 in. (−1.27 mm). In another example, the facet exposure difference may be less than 0.25 in. (6.4 mm). In yet other examples, the facet exposure difference may be any value in a range between −0.05 in. (−1.27 mm) and 0.25 in. (6.4 mm). In some embodiments, it may be critical that the facet exposure difference is between 0 in. (0 mm) and 0.05 in. (1.27 mm) to help to reduce or prevent the trailing cutting surface 234-3 from engaging the formation during operation.

In accordance with at least one embodiment of the present disclosure, the trailing cutting surface 234-3 may be a backup cutting surface for the forward cutting surface 234-1. For example, during operation, the forward cutting surface 234-1 may experience wear. When the performance of the forward cutting surface 234-1 is reduced due to wear, the faceted cutting element 232 may be rotated to orient the trailing cutting surface 234-3 to face forward (e.g., face in the same direction as the leading surface 216). For example, when the bit 210 is being refurbished at the surface, the blade 214 may be heated to above the brazing temperature of the braze material. This may cause the braze material to melt. When the braze material is melted, the faceted cutting element 232 may be rotated so that the trailing cutting surface 234-3 faces forward. Subsequent brazing may secure the reoriented faceted cutting element 232 in the pocket 230. This may help to extend the operating lifetime of the faceted cutting element 232.

As discussed herein, the trailing cutting surface 234-3 may be transverse to the base 252. In some embodiments, the trailing cutting surface 234-3 may have the same cutting surface angle (e.g., rake angle) as the forward cutting surface 234-1. For example, when the faceted cutting element 232 is rotated to place the trailing cutting surface 234-3 to face forward, the trailing cutting surface 234-3 may have the same cutting surface angle 265 (e.g., rake angle) as the forward cutting surface 234-1 when facing forward. In some embodiments, the trailing cutting surface 234-3 may have a different cutting surface angle 265 than the forward cutting surface 234-1 when the trailing cutting surface 234-3 is facing forward. For example, the trailing cutting surface 234-3 may have a greater cutting surface angle 265 than the forward cutting surface 234-1 when the trailing cutting surface 234-3 is facing forward. In some examples, the trailing cutting surface 234-3 may have a smaller cutting surface angle 265 than the forward cutting surface 234-1 when the trailing cutting surface 234-3 is facing forward.

In accordance with at least one embodiment of the present disclosure, the faceted cutting element 232 includes an upper surface 258 that recesses into the ultrahard layer 246. For example, as may be seen, the upper surface 258 forms a recess 260, such as a detent, divot, or other negative space that is recessed into the ultrahard layer 246. The recess 260 in the upper surface 258 may provide relief for the forward cutting surface 234-1 to engage and cut the formation. As may be understood, without relief associated with a cutting surface, the cutting surface may not efficiently cut the formation. For example, a cutting surface that has no relief may slide along the formation. Such a cutting element having no relief may serve as a depth-of-cut limiter for the primary cutting element 228. By including the recess 260 in the upper surface 258, the faceted cutting element 232 may have relief for the various cutting surfaces 234, thereby allowing the faceted cutting element 232 to serve as a primary and/or secondary cutting element. For example, the faceted cutting element 232 may be located at the leading surface 216 of the blade 214. In this manner, the faceted cutting element 232 may be a primary cutting element. In some embodiments, the faceted cutting element 232 may be both the primary and secondary cutting elements on a particular blade 214.

The faceted cutting element 232 includes a relief angle 267 between the cutting surfaces 234 and the upper surface 258. In some embodiments, the relief angle 267 may be in a range having an upper value, a lower value, or upper and lower values including any of 60°, 70°, 80°, 85°, 90°, 95°, 100°, 105°, 110°, or any value therebetween. For example, the relief angle 267 may be greater than 60°. In another example, the relief angle 267 may be less than 110°. In yet other examples, the relief angle 267 may be any value in a range between 60° and 110°. In some embodiments, it may be critical that the relief angle 267 is between 80° and 110° to provide relief to allow the cutting surfaces 234 to engage the formation.

In some embodiments, the relief angle 267 for two or more of the cutting surfaces 234 may be the same. In some embodiments, the relief angle 267 for two or more of the cutting surfaces 234 may be different. For example, the forward cutting surface 234-1 may have a different relief angle 267 than the adjacent cutting surfaces 234-2. In some examples, the forward cutting surface 234-1 may have a different relief angle 267 than the trailing cutting surface 234-3. In some examples, the adjacent cutting surfaces 234-2 may have a different relief angle 267 than the trailing cutting surface 234-3.

The relief angle 267 may provide relief for the ultrahard layer 246 to cut the formation. For example, when the cutting edge of the forward cutting surface 234-1 engages the formation, the relief angle 267 may allow the rock to break and be removed into the space behind the forward cutting surface 234-1. In this manner, the faceted cutting element 232 may engage and remove rock from the formation.

The recess 260 has a recess distance 221 between the forward facet tip 275 and a base of the recess 260. In some embodiments, the recess distance 221 may be in a range having an upper value, a lower value, or upper and lower values including any of 0.01 in. (0.25 mm), 0.02 in. (0.51 mm), 0.03 in. (0.76 mm), 0.04 in. (1.02 mm), 0.05 in. (1.27 mm), 0.1 in. (2.5 mm), or any value therebetween. For example, the recess distance 221 may be greater than 0.01 in. (0.25 mm). In another example, the recess distance 221 may be less than 0.1 in. (2.5 mm). In yet other examples, the recess distance 221 may be any value in a range between 0.01 in. (0.25 mm) and 0.1 in. (2.5 mm). In some embodiments, it may be critical that the recess distance 221 is between 0.01 in. (0.25 mm) and 0.05 in. (1.27 mm) to facilitate the faceted cutting element 232 removing the formation with a scraping motion. In some embodiments, the forward facet tip 275 and the rearward facet tip 277 may have a different recess distance 221 to the base of the recess 260.

When the faceted cutting element 232 is installed in the faceted cutting element pockets 230, a line 262 may extend through the upper surface 258, the base 252, and the pocket base 248 without extending through any of the cutting surfaces 234. It should be understood that the line 262 is illustrated to demonstrate cross-sectional features along the length of the faceted cutting element 232, and the line 262 may not be a physical feature of the faceted cutting element 232. For example, the line 262 may intersect the circular pocket base 248. In some embodiments, the line 262 may be perpendicular to the pocket base 248. The line 262 may also intersect the base 252. In some embodiments, the line 262 may be perpendicular to the base 252. The line 262 may extend through the substrate 244. In some embodiments, the line 262 may extend through the upper surface 258 and into the ultrahard layer 246. The line 262 may pass out of the ultrahard layer 246 in the upper surface 258. In some embodiments, the line 262 may pass out of the ultrahard layer 246 in the recess 260. In some embodiments, the line 262 may not intersect one or more of the cutting surfaces 234. In some embodiments, the line 262 may not intersect any of the cutting surfaces 234. In some embodiments, the line 262 may not intersect the side surface 254 of the faceted cutting element 232.

Figures 2, 3, 4:
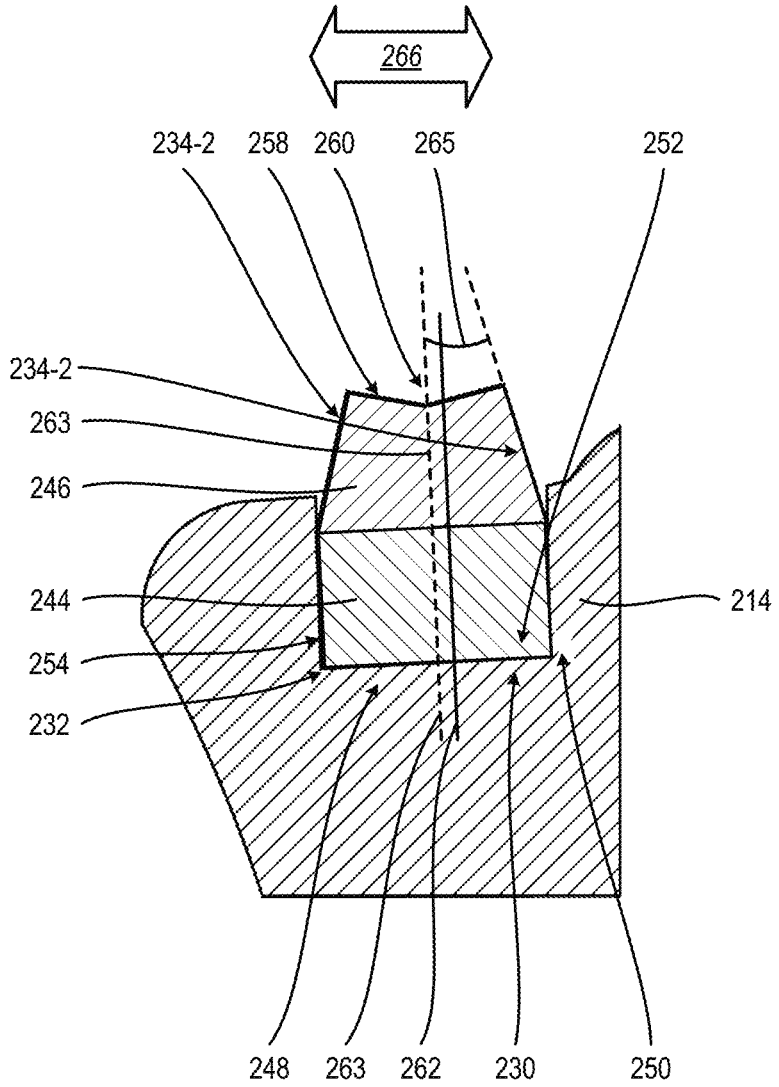
Figures 1, 3:
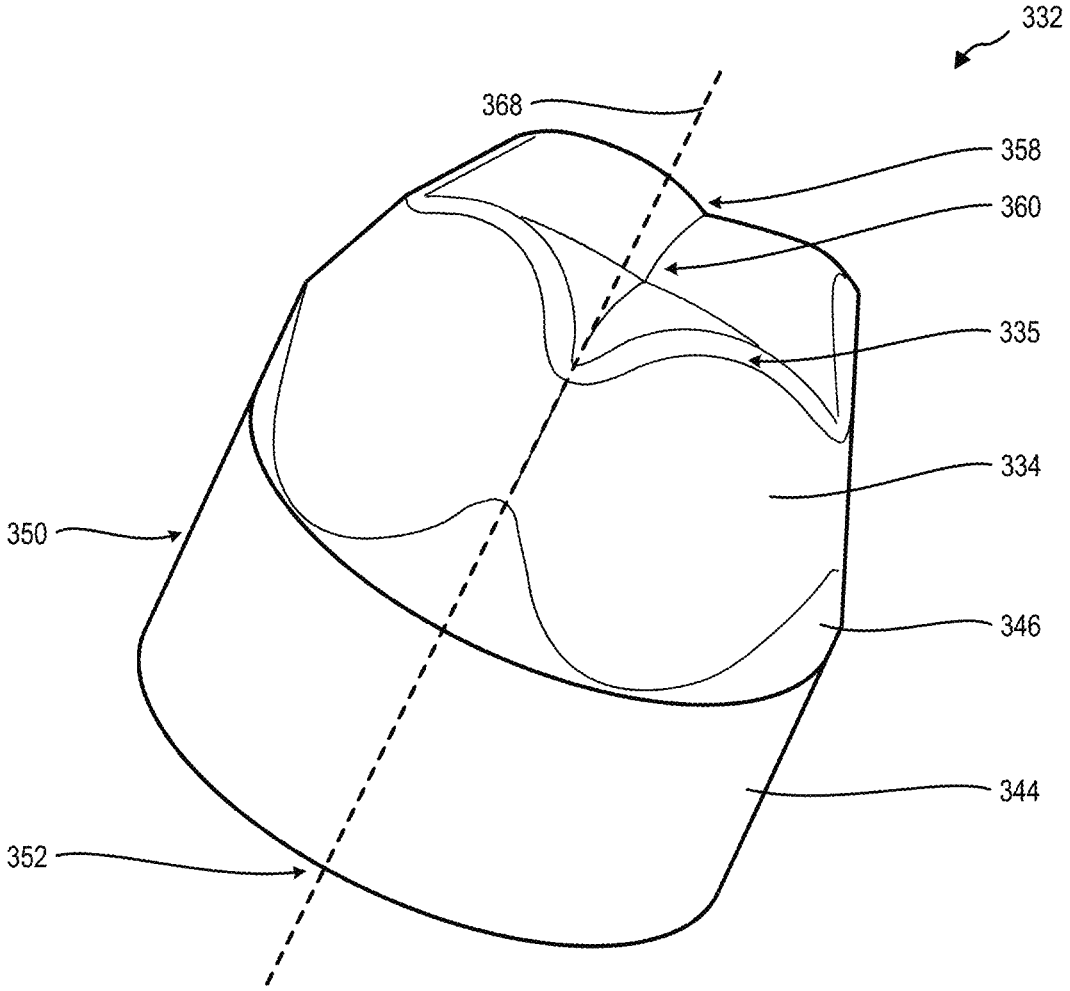
Figures 2, 3:
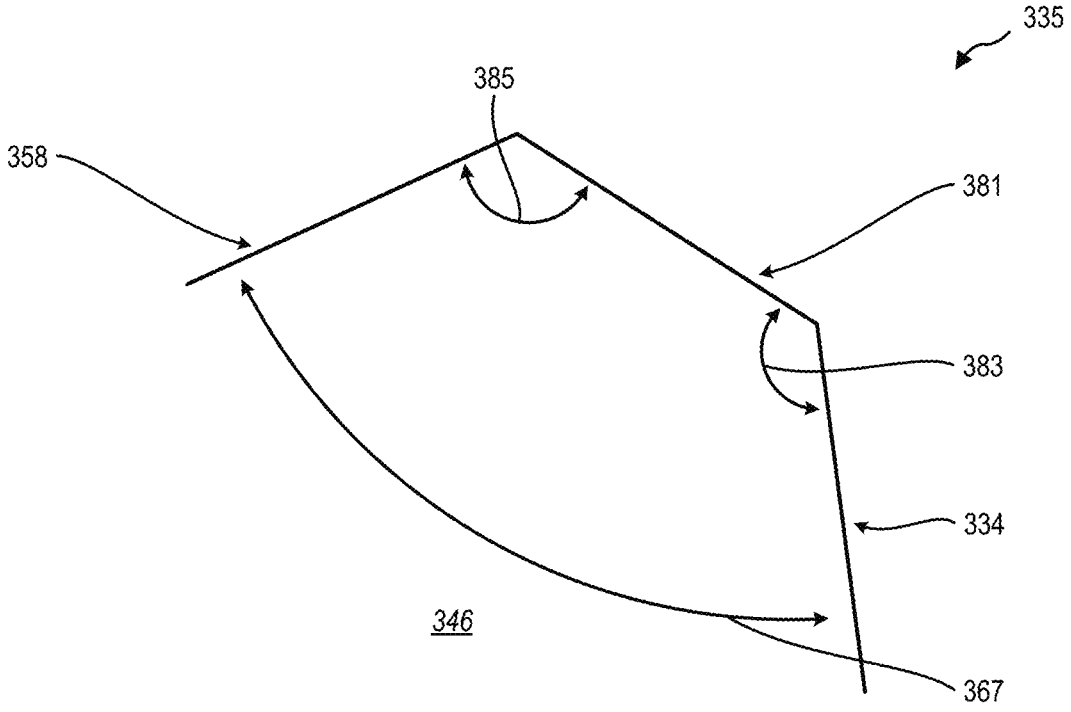
Figure 4:
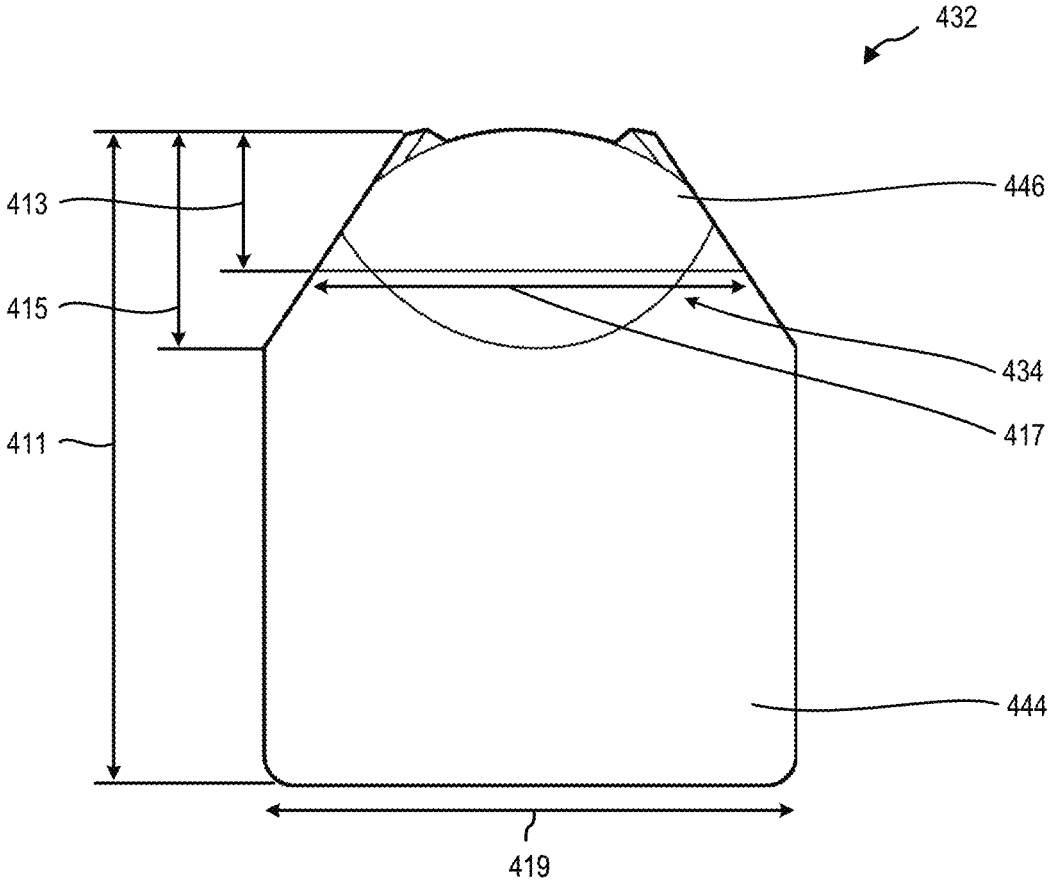

FIG. 2-4 is a cross-sectional view of the blade 214 and faceted cutting element 232 of the bit 210 and along the line 2-2 in FIG. 2-2. In the view shown, the adjacent cutting surfaces 234-2 are adjacent to the forward cutting surface 234-1 and the trailing cutting surface 234-3. As discussed herein, the adjacent cutting surfaces 234-2 may be transverse to the base 252. The adjacent cutting surfaces 234-2 have a cutting surface angle 265 between the adjacent cutting surfaces 234-2 and the cutting element axis 263.

As discussed herein, during drilling activities, the bit 210 may experience movement in a lateral direction 266. As the bit 210 moves in the lateral direction 266, the adjacent cutting surfaces 234-2 may engage portions of the wellbore bottom. For example, grooves may be cut in the wellbore bottom by other cutting elements, such as other primary cutting element 228 and/or other faceted cutting element 232. The adjacent cutting surfaces 234-2 may engage the formation and remove a portion of the formation. This may help to increase the cutting efficiency of the bit 210. The adjacent cutting surfaces 234-2 may reduce chipping or wear of one or more cutting elements of the bit 210.

In some embodiments, the cutting surface angle 265 of both adjacent cutting surfaces 234-2 may be the same. In some embodiments, the cutting surface angle 265 of the adjacent cutting surfaces 234-2 may be different.

As discussed herein, the faceted cutting element 232 includes an upper surface 258 that is recessed into the ultrahard layer 246. For example, as may be seen, the upper surface 258 forms a recess 260. The recess 260 in the upper surface 258 may provide relief for the forward cutting surface adjacent cutting surfaces 234-2 to engage and cut the formation. By including the recess 260 in the upper surface 258, the faceted cutting element 232 may have relief for the adjacent cutting surfaces 234-2.

As discussed above, when the faceted cutting element 232 is installed in the faceted cutting element pockets 230, a line 262 may extend through the upper surface 258, the base 252, and the pocket base 248 without extending through the adjacent cutting surfaces 234-2. For example, the line 262 may intersect the circular pocket base 248, the base 252, the substrate 244, the ultrahard layer 246, the upper surface 258, and combinations thereof. In some embodiments, the line 262 may pass out of the ultrahard layer 246 in the recess 260.

FIG. 3-1 is a perspective view of a representation of a faceted cutting element 332, according to at least one embodiment of the present disclosure. The faceted cutting element 332 includes a substrate 344 and an ultrahard layer 346 bonded to the substrate 344. As discussed herein, the substrate 344 may include a base 352 having a circular cross-sectional shape. The faceted cutting element 332 includes a sidewall 350. The sidewall 350 may extend from the base 352 to an upper surface 358. In some embodiments, the sidewall 350 in the substrate 344 may be straight. In some embodiments, the sidewall 350 may not be straight in the ultrahard layer 346. For example, the sidewall 350 may include a plurality of cutting surfaces 334. The surfaces 334 may extend inward toward a central axis 368 of the faceted cutting element 332.

As discussed herein, the upper surface 358 may include an indentation 360. For example, the upper surface 358 may recess into the ultrahard layer 346 toward the base 352. This may form the indentation 360. The indentation 360 may provide relief for each of the cutting surfaces 334 to engage the formation. In some embodiments, a low point (e.g., the furthest into the ultrahard layer 346 that the indentation 360 is recessed) of the upper surface 358 may be concentric with the central axis 368. In some embodiments, the low point of the upper surface 358 may be offset from the central axis 368. For example, if different cutting surfaces 334 have different relief angles (e.g., the relief angle 267 of FIG. 2-3), which may result in an offset low point of the 358.

As may be seen, the cutting surface 334 may have a cutting edge 335. The cutting edge 335 may have an arcuate shape, or a shape that curves downward from a peak. The shape of the cutting edge 335 may allow the cutting surface 334 to engage the formation and remove at least a portion of the formation. This curve of the cutting edge 335 may help to improve the cutting action of the cutting surfaces 334, thereby improving the efficiency of the faceted cutting element 332.

In the embodiment shown, the faceted cutting element 332 has six cutting surfaces 334. However, it should be understood that the faceted cutting element 332 may have any number of cutting surfaces 334. For example, the faceted cutting element 332 may have 2, 3, 4, 5, 6, or more cutting surfaces 334. In some embodiments, adjacent cutting surfaces may be oriented approximately 90° from each other. In some embodiments, adjacent cutting surfaces may be oriented approximately 120° from each other. Multiple cutting surfaces 334 may allow the faceted cutting element 332 to engage the formation based on any movement direction of the bit. In some embodiments, multiple cutting surfaces 334 may provide multiple backup cutting surfaces for the faceted cutting element 332.

The cutting surface 334 may include a bevel at the cutting edge 335. As may be seen in FIG. 3-2, which is a representation of the cutting edge 335 illustrating a bevel between the upper surface 358 of the ultrahard layer 346 and a cutting surface 334 of the ultrahard layer 346. As discussed above with respect to FIG. 2-3, the upper surface 358 and the cutting surface 334 form a relief angle 367. The bevel may include one or more surfaces between the upper surface 358 and the cutting surface 334. For example, in the embodiment shown, the bevel includes a bevel surface 381 between the cutting surface 334 and the upper surface 358. The bevel surface 381 may help to improve the cutting action of the faceted cutting element 332, particularly when the faceted cutting element 332 is engaging the formation with a scraping motion.

The bevel surface 381 may form a first bevel angle 383 between the bevel surface 381 and the cutting surface 334. The bevel surface 381 may form a second bevel angle 385 between the bevel surface 381 and the upper surface 358. The sum of the first bevel angle 383 plus the second bevel angle 385, minus 180°, may equal the relief angle 367. In some embodiments, the first bevel angle 383 and/or the second bevel angle 385 may be in a range having an upper value, a lower value, or upper and lower values including any of 95°, 100°, 110°, 120°, 130°, 140°, 150°, 160°, 170°, 175°, or any value therebetween. For example, the first bevel angle 383 and/or the second bevel angle 385 may be greater than 95°. In another example, the first bevel angle 383 and/or the second bevel angle 385 may be less than 175°. In yet other examples, the first bevel angle 383 and/or the second bevel angle 385 may be any value in a range between 95° and 175°. In some embodiments, it may be critical that the first bevel angle 383 and/or the second bevel angle 385 is between 110° and 150° to improve the cutting action of the faceted cutting element 332 engaging the formation.

While FIG. 3-2 illustrates a single bevel surface 381, the bevel may include multiple bevel surfaces. For example, the bevel may include 1, 2, 3, 4, 5, 6, 7, 8, 9, 10, or more bevel surfaces. The total bevel surfaces may be angled between the cutting surface 334 and the upper surface 358 to form the relief angle 367.

FIG. 4 is a representation of side view of a faceted cutting element 432, according to at least one embodiment of the present disclosure. The faceted cutting element 432 includes a substrate 444 with an ultrahard layer 446 joined to the substrate 444. The faceted cutting element 432 includes multiple cutting surfaces 434. The multiple cutting surfaces 434 may be configured to engage the surface of a formation with a scraping motion.

The faceted cutting element 432 has a cutting element height 411. In some embodiments, the cutting element height 411 may be in a range having an upper value, a lower value, or upper and lower values including any of 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), or any value therebetween. For example, the cutting element height 411 may be greater than 0.5 in. (1.3 cm). In another example, the cutting element height 411 may be less than 1.0 in. (2.5 cm). In yet other examples, the cutting element height 411 may be any value in a range between 0.5 in. (1.3 cm) and 1.0 in. (2.5 cm). In some embodiments, it may be critical that the cutting element height 411 is between 0.5 in. (1.3 cm) and 0.7 in. (1.8 cm) to facilitate the faceted cutting element 432 operating as a primary cutting element.

The ultrahard layer 446 has an ultrahard layer height 413. In some embodiments, the ultrahard layer height 413 may be in a range having an upper value, a lower value, or upper and lower values including any of 0.1 in. (2.5 mm), 0.15 in. (3.8 mm), 0.2 in. (5.6 mm), 0.25 in. (6.4 mm), 0.3 in. (7.6 mm), 0.35 in. (8.9 mm), 0.4 in. (1.0 cm), 0.45 in. (1.1 cm), 0.5 in. (1.3 cm), or any value therebetween. For example, the ultrahard layer height 413 may be greater than 0.1 in. (2.5 mm). In another example, the ultrahard layer height 413 may be less than 0.5 in. (1.3 cm). In yet other examples, the ultrahard layer height 413 may be any value in a range between 0.1 in. (2.5 mm) and 0.5 in. (1.3 cm). In some embodiments, it may be critical that the ultrahard layer height 413 is between 0.1 in. (2.5 mm) and 0.2 in. (6.4 mm) to facilitate the faceted cutting element 432 operating as a primary cutting element.

As may be seen, the cutting surface 434 may extend into the substrate 444. Put another way, the cutting surface 434 may extend across the ultrahard layer 446 and at least a portion of the substrate 444. For example, the cutting surface 434 may extend a cutting surface height 415. In some embodiments, the cutting surface height 415 may be in a range having an upper value, a lower value, or upper and lower values including any of 0.1 in. (2.5 mm), 0.15 in. (3.8 mm), 0.2 in. (5.6 mm), 0.25 in. (6.4 mm), 0.3 in. (7.6 mm), 0.35 in. (8.9 mm), 0.4 in. (10.1 mm), 0.45 in. (11.4 mm), 0.5 in. (12.7 mm), 0.6 in. (15.2 mm), 0.7 in. (17.8 mm), 0.8 in. (20.3 mm), 0.9 in. (22.9 mm), 1.0 in. (25.4 mm), or any value therebetween. For example, the cutting surface height 415 may be greater than 0.1 in. (2.5 mm). In another example, the cutting surface height 415 may be less than 1.0 in. (25.4 mm). In yet other examples, the cutting surface height 415 may be any value in a range between 0.1 in. (2.5 mm) and 1.0 in. (25.4 mm). In some embodiments, it may be critical that the cutting surface height 415 is between 0.2 in. (6.4 mm) and 0.5 in. (12.7 mm) to facilitate the faceted cutting element 432 operating as a primary cutting element.

The ultrahard layer height 413 may be an ultrahard layer percentage of the cutting surface height 415 (e.g., the ultrahard layer height 413 divided by the cutting surface height 415). In some embodiments, the ultrahard layer percentage may be in a range having an upper value, a lower value, or upper and lower values including any of 10%, 20%, 30%, 40%, 50%, 60%, 70%, 80%, 90%, 100%, or any value therebetween. For example, the ultrahard layer percentage may be greater than 10%. In another example, the ultrahard layer percentage may be less than 100%. In yet other examples, the ultrahard layer percentage may be any value in a range between 10% and 100%. In some embodiments, it may be critical that the ultrahard layer percentage is between 30% and 80% to facilitate the faceted cutting element 432 acting as a primary cutting element.

The ultrahard layer 446 has an ultrahard layer diameter 417. In some embodiments, the ultrahard layer diameter 417 may be in a range having an upper value, a lower value, or upper and lower values including any of 0.1 in. (2.5 mm), 0.15 in. (3.8 mm), 0.2 in. (5.6 mm), 0.25 in. (6.4 mm), 0.3 in. (7.6 mm), 0.35 in. (8.9 mm), 0.4 in. (10.1 mm), 0.45 in. (11.4 mm), 0.5 in. (12.7 mm), 0.6 in. (15.2 mm), 0.7 in. (17.8 mm), 0.8 in. (20.3 mm), 0.9 in. (22.9 mm) 1.0 in. (25.4 mm), or any value therebetween. For example, the ultrahard layer diameter 417 may be greater than 0.1 in. (2.5 mm). In another example, the ultrahard layer diameter 417 may be less than 1.0 in. (25.4 mm). In yet other examples, the ultrahard layer diameter 417 may be any value in a range between 0.1 in. (2.5 mm) and 1.0 in. (25.4 mm). In some embodiments, it may be critical that the ultrahard layer diameter 417 is between 0.15 in. (3.8 mm) and 0.3 in. (7.6 mm) to facilitate the faceted cutting element 432 acting as a primary cutting element. In some embodiments, the ultrahard layer diameter 417 decreases from a maximum value near an interface with the substrate 444 to a minimum value toward the tips of the cutting surfaces 434.

The faceted cutting element 432 has a base diameter 419. In some embodiments, the base diameter 419 may be in a range having an upper value, a lower value, or upper and lower values including any of 0.3 in. (7.6 mm), 0.4 in. (1.0 cm), 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), 1.25 in. (3.2 cm), 1.5 in. (3.8 cm), or any value therebetween. For example, the base diameter 419 may be greater than 0.3 in. (7.6 mm). In another example, the base diameter 419 may be less than 1.5 in. (3.8 cm). In yet other examples, the base diameter 419 may be any value in a range between 0.3 in. (7.6 mm) and 1.5 in. (3.75 cm). In some embodiments, it may be critical that the base diameter 419 is between 0.3 in. (7.6 mm) and 0.7 in. (1.8 cm) to facilitate the faceted cutting element 432 operating as a primary cutting element.

The ultrahard layer diameter 417 may be an ultrahard diameter percentage of the base diameter 419 (e.g., the ultrahard layer diameter 417 divided by the base diameter 419). In some embodiments, the ultrahard diameter percentage may be in a range having an upper value, a lower value, or upper and lower values including any of 10%, 20%, 30%, 40%, 50%, 60%, 70%, 80%, 90%, 100%, or any value therebetween. For example, the ultrahard diameter percentage may be greater than 10%. In another example, the ultrahard diameter percentage may be less than 100%. In yet other examples, the ultrahard diameter percentage may be any value in a range between 10% and 100%. In some embodiments, it may be critical that the ultrahard diameter percentage is between 30% and 80% to facilitate the faceted cutting element 432 acting as a primary cutting element.

Figure 5:
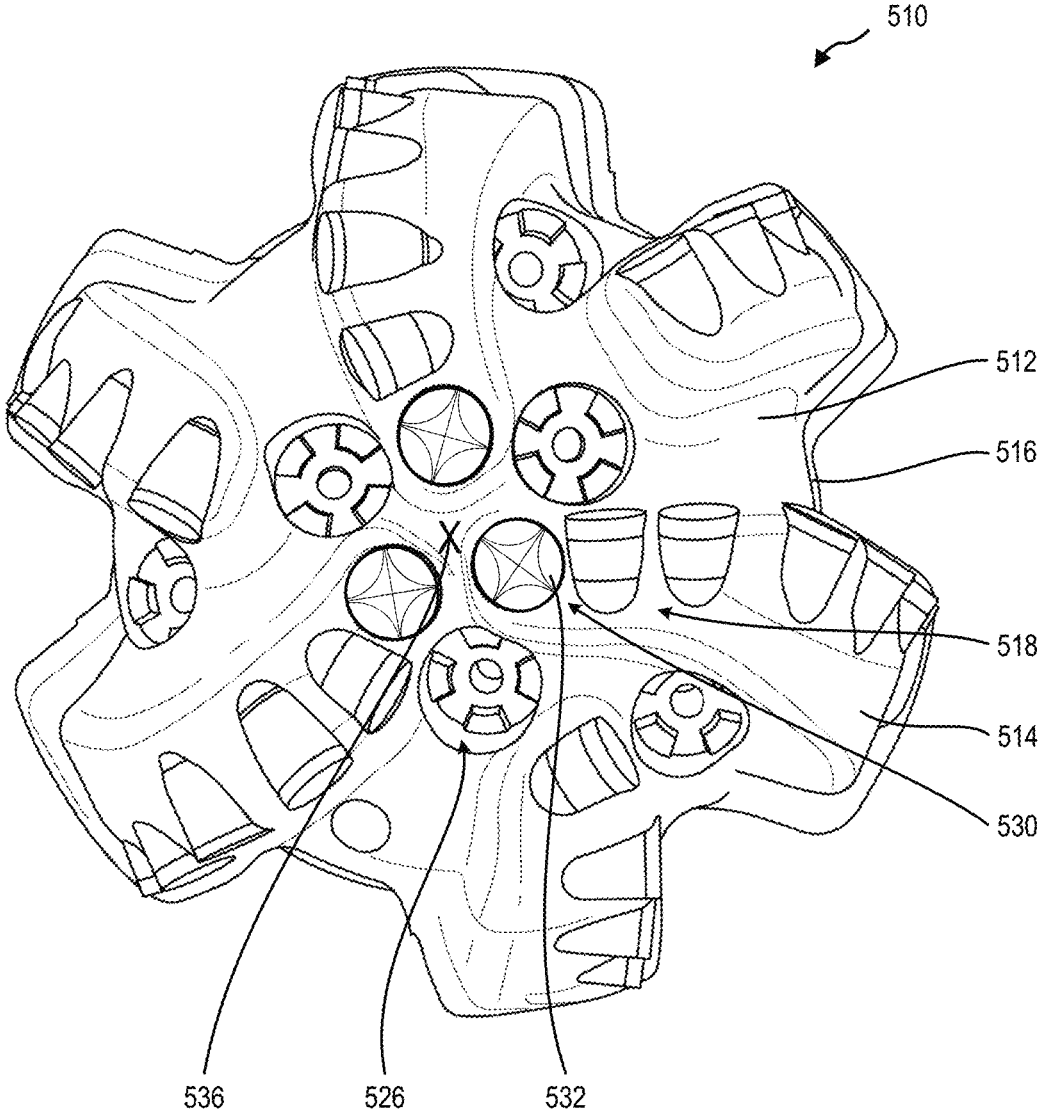
FIG. 5 is a schematic representation of a bottom view of a bit, according to at least one embodiment of the present disclosure.

FIG. 5 is a representation of a bottom view of a bit 510, according to at least one embodiment of the present disclosure. The bit 510 includes a bit body 512 with a plurality of blades 514 extending therefrom. The blades 514 include a nose region 526 near the axis 536 of the bit 510. At the nose region 526, the width of the plurality of blades 514 may be insufficient to secure a primary and a secondary cutting element. Further, at the nose region 526, there may not be room between adjacent blades 514 for conventional tooling to install a lateral cutter pocket on a leading surface 516 of the plurality of blades 514.

In accordance with at least one embodiment of the present disclosure, a faceted cutting element pocket 530 may be installed in the nose region 526 of the bit 510, such as within one or more of a plurality of blades 514. A machine tool may form the faceted cutting element pocket 530 in an outer surface 518 of the nose region 526 of the bit 510. A faceted cutting element may be secured to the bit 510 at the faceted cutting element pocket 530. As may be seen, the faceted cutting element 532 installed in the nose region 526 may be a primary cutting element.

Figure 6:
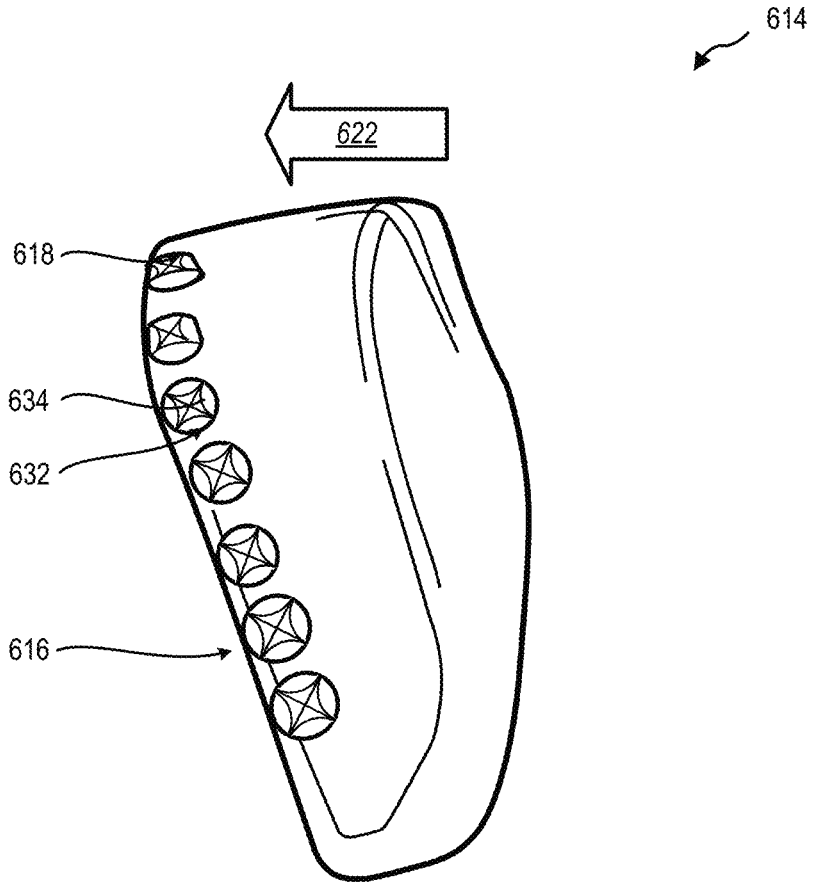
FIG. 6 is a representation of a blade of a bit, according to at least one embodiment of the present disclosure.

FIG. 6 is a representation of a blade 614 having a faceted cutting element 632 installed in an outer surface 618 of the blade 614, according to at least one embodiment of the present disclosure. The blade 614 may be oriented to rotate in a rotational direction 622. In the embodiment shown, the faceted cutting element 632 is installed on the outer surface 618 at or proximate to a leading surface 616 of the blade 614. The faceted cutting element 632 includes a cutting surface 634 that is oriented to face rotationally forward, or oriented to face toward the leading surface 616.

In the embodiment shown, the faceted cutting element 632 is a primary cutting element. For example, the faceted cutting element 632 is located at or proximate to the leading surface 616. This may cause the cutting surface 634 to be a primary cutting surface, having a full cutting load. As discussed herein, the faceted cutting element 632 may be versatile, and locating the faceted cutting element 632 at the leading surface 616 may help to improve the versatility and/or cutting efficiency of the blade 614.

Figure 7:
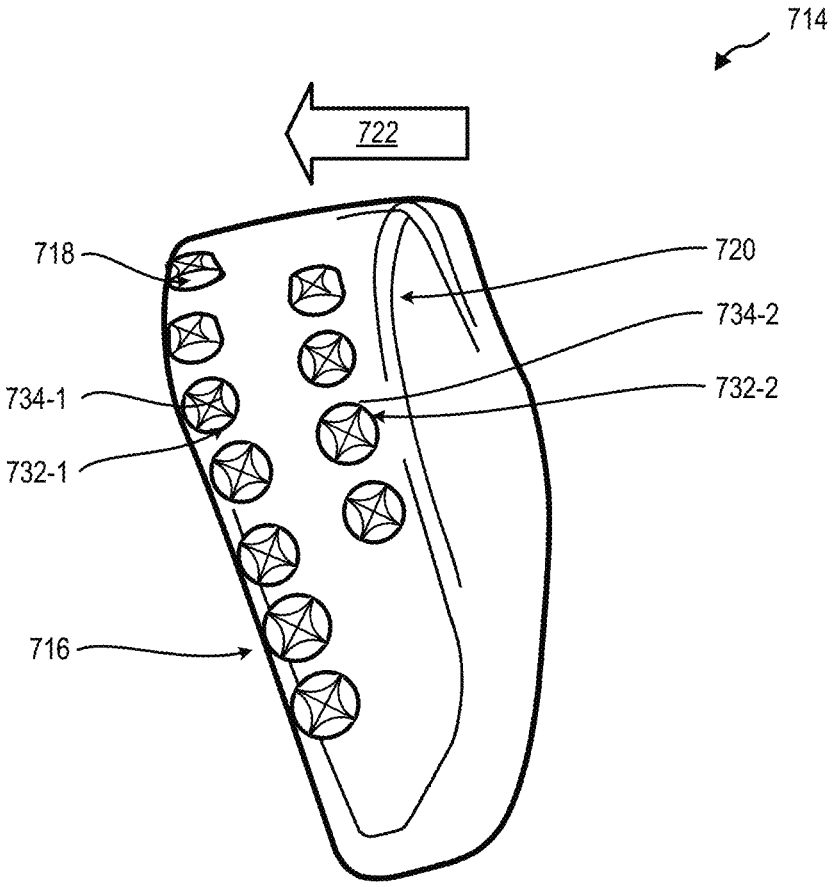
FIG. 7 is a representation of a blade of a bit, according to at least one embodiment of the present disclosure.

FIG. 7 is a representation of a blade 714 having multiple faceted cutting elements (collectively 732) installed in an outer surface 718 of the blade 714, according to at least one embodiment of the present disclosure. The blade 714 may be oriented to rotate in a rotational direction 722. In the embodiment shown, a first faceted cutting element 732-1 is installed on the outer surface 718 at or proximate to a leading surface 716 of the blade 714. The first faceted cutting element 732-1 includes a first cutting surface 734-1 that is oriented to face rotationally forward, or oriented to face toward the leading surface 716. In this manner, the first faceted cutting element 732-1 may be a primary cutting element.

The blade 714 may further include a second faceted cutting element 732-2. The second faceted cutting element 732-2 may be located closer to a trailing surface 720 of the blade 714. The second faceted cutting element 732-2 may include a second cutting surface 734-2. The second cutting surface 734-2 may be oriented toward the leading surface 716 of the outer surface 718. In the embodiment shown, the second faceted cutting element 732-2 may be a secondary or a backup cutting element to the first faceted cutting element 732-1. For example, the second cutting surface 734-2 may be placed or oriented to cut along the same cutting path as the first cutting surface 734-1. In some examples, the second cutting surface 734-2 may be placed or oriented to cut along a different cutting path as the first cutting surface 734-1. In this manner, the blade 714 may include both primary and backup cutting elements that are faceted cutting element in accordance with at least one embodiment of the present disclosure.

Figures 1, 8:
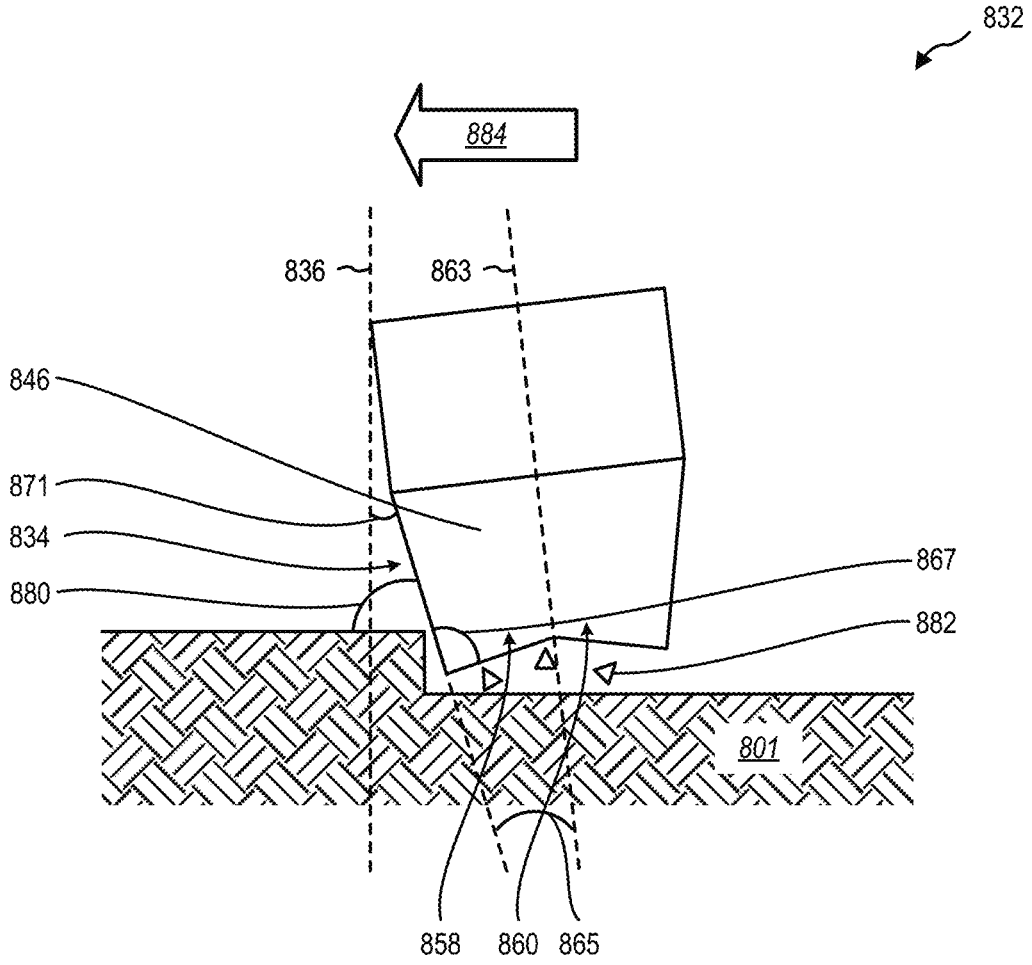
Figures 2, 8:
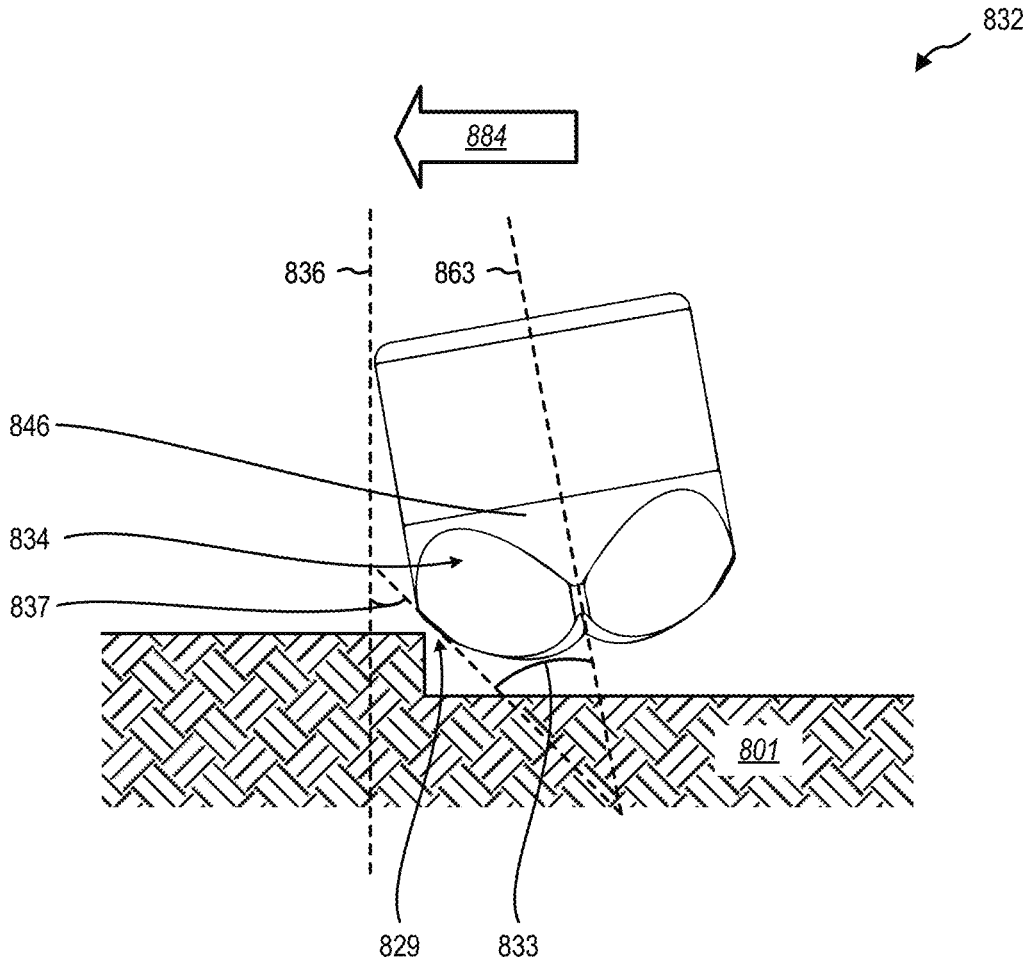

FIG. 8-1 is a representation of a faceted cutting element 832 in a cutting orientation, according to at least one embodiment of the present disclosure. The faceted cutting element 832 may be oriented to engage a rock formation 801. For example, an ultrahard layer 846 of the faceted cutting element 832 may be oriented to contact the rock formation 801 to remove at least a portion of the rock formation 801.

As may be seen, a cutting surface 834 may be configured to contact the rock formation 801. The cutting surface 834 may engage the rock formation 801 with an engagement angle 880. The engagement angle 880 may be the angle with which the cutting surface 834 engages the rock formation 801. The cutting surface 834 may have a backrake angle, which may be the angle of the cutting surface with respect to a line normal to the formation 801 being cut. In the view shown, the backrake angle is 90° minus the engagement angle.

As may be seen, the engagement angle 880 and the backrake angle may be impacted by the orientation of the cutting element 832. For example, the cutting surface 834 includes a cutting surface angle 865 with respect to a cutting element axis 863 of the cutting element. A change in the cutting surface angle 865 may change the engagement angle 880. The cutting surface 834 further includes a facet rake angle 871 with respect to the bit rotational axis 836. Changing the orientation of the faceted cutting element 832 may cause a change in the facet rake angle 871 and a resulting change in the engagement angle 880.

In accordance with at least one embodiment of the present disclosure, the faceted cutting element 832 may include an indentation 860 formed by a relief angle 867 between the cutting surface 834 and an upper surface 858. When the ultrahard layer 846 engages the formation, the indentation 860 may provide relief for cuttings 882, such as rock chips or other removed portions of the rock formation 801, to travel as the ultrahard layer 846 degrades the rock formation 801. In this manner, the faceted cutting element 832 may act as a shearing cutting element. This may help the faceted cutting element 832 to cut based on a lateral motion, or a motion in a lateral direction 884.

As may be understood, the faceted cutting element 832 may be oriented in any orientation, with any engagement angle 880, and with any relief angle 867. Changing the engagement angle 880 and/or relief angle 867 may adjust the cutting action and/or cutting motion of the faceted cutting element 832. In this manner, the faceted cutting element 832 may be adjusted for use at any portion of a bit.

FIG. 8-2 is a representation of a faceted cutting element 832 oriented to cut the formation 801 at an edge 829 between two adjacent cutting surfaces 834. For example, an ultrahard layer 846 may include a plurality of cutting surfaces 834 having an edge 829 between adjacent cutting surfaces 834. Engaging the formation 801 with the edge 829 between adjacent cutting surfaces 834 may improve the cutting efficiency of the faceted cutting element.

The edge 829 may have an edge angle 833 formed between the edge 829 and the cutting element axis 863 of the faceted cutting element 832. The edge 829 may further include a bit edge angle 837 between the edge 829 and the bit rotational axis 836. The respective edge angle 833 and bit edge angle 837 may impact the angle at which the edge 829 may engage the formation 801.

Figures 1, 9:
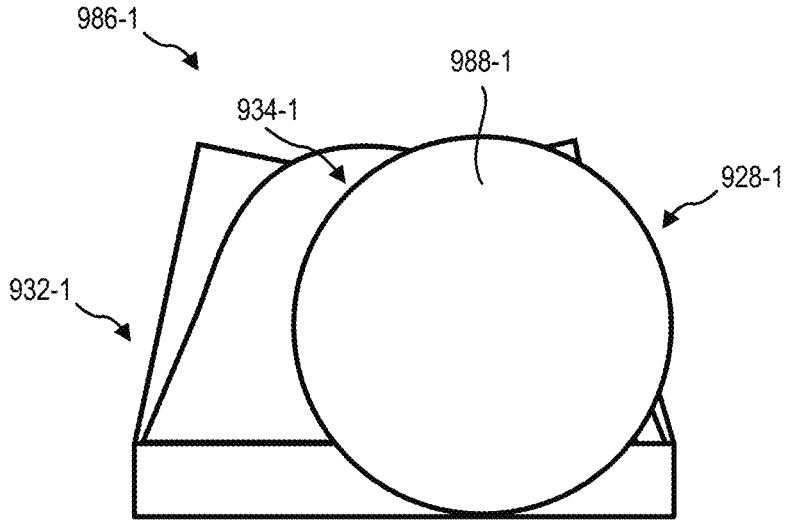
Figures 2, 9:
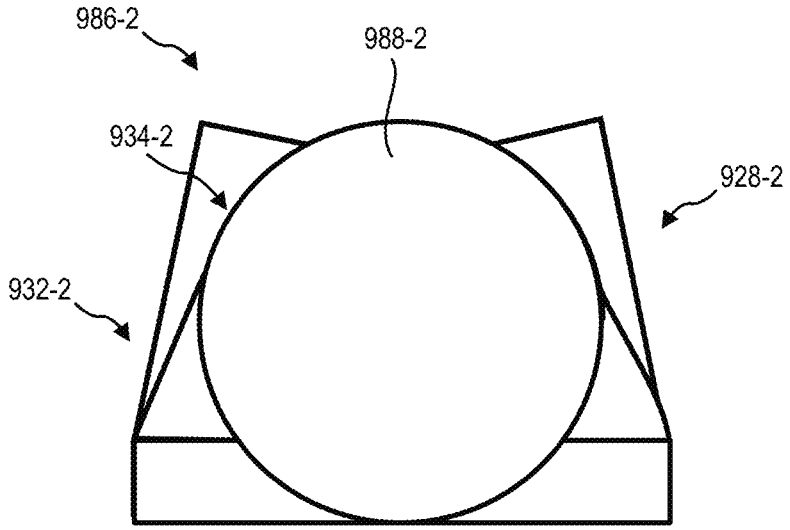

FIG. 9-1 and FIG. 9-2 are representations of cutting profiles (collectively 986) of a primary cutting element (collectively 928) and a faceted cutting element (collectively 932), according to at least one embodiment of the present disclosure. The primary cutting element 928 may be located rotationally in front of the faceted cutting element 932.

In FIG. 9-1, a first cutting profile 986-1 includes a first primary cutting element 928-1 located in front of a first faceted cutting element 932-1. The first primary cutting element 928-1 has a first primary cutting surface 988-1 that may engage the formation before a first secondary cutting surface 934-1 on the first faceted cutting element 932-1. In the embodiment shown in FIG. 9-1, the first faceted cutting element 932-1 may be offset from the first primary cutting element 928-1. The first secondary cutting surface 934-1 may not completely overlap the first primary cutting surface 988-1. In this manner, the first faceted cutting element 932-1 may be a backup cutting element, or may engage a different portion of the formation than the first primary cutting element 928-1. This may help to clean the formation and/or remove additional portions of the formation.

In FIG. 9-2, a second cutting profile 986-2 includes a second primary cutting element 928-2 located in front of a second faceted cutting element 932-2. The second primary cutting element 928-2 has a second primary cutting surface 988-2 that may engage the formation before a second secondary cutting surface 934-2 on the second faceted cutting element 932-2. In the embodiment shown in FIG. 9-2, the second faceted cutting element 932-2 is aligned with the second primary cutting element 928-2. For example, the second faceted cutting element 932-2 may be located rotationally behind and with the same radial distance away from the bit rotational axis as the second primary cutting element 928-2. In this manner, the second primary cutting surface 988-2 and the second secondary cutting surface 934-2 may cut along the same path. The second secondary cutting surface 934-2 may cut material from the formation that the second primary cutting surface 988-2 is unable to cut or reach. In this manner, the second faceted cutting element 932-2 may be a backup cutting element to the second primary cutting element 928-2. In some embodiments, when the second primary cutting element 928-2 wears and/or breaks, the second faceted cutting element 932-2 may cut the formation along the same path, thereby reducing the impact of the worn and/or broken second primary cutting element 928-2.

While FIG. 9-1 and FIG. 9-2 have been illustrated with the primary cutting element 928 located in front of the faceted cutting element 932, it should be understood that the faceted cutting element 932 may be located in front of the primary cutting element 928. In some examples, the faceted cutting element 932 may be located in front of another faceted cutting element 932. In this manner, the faceted cutting element 932 may be a primary cutting element, or a cutting element located rotationally in front of another cutting element.

Figure 10:
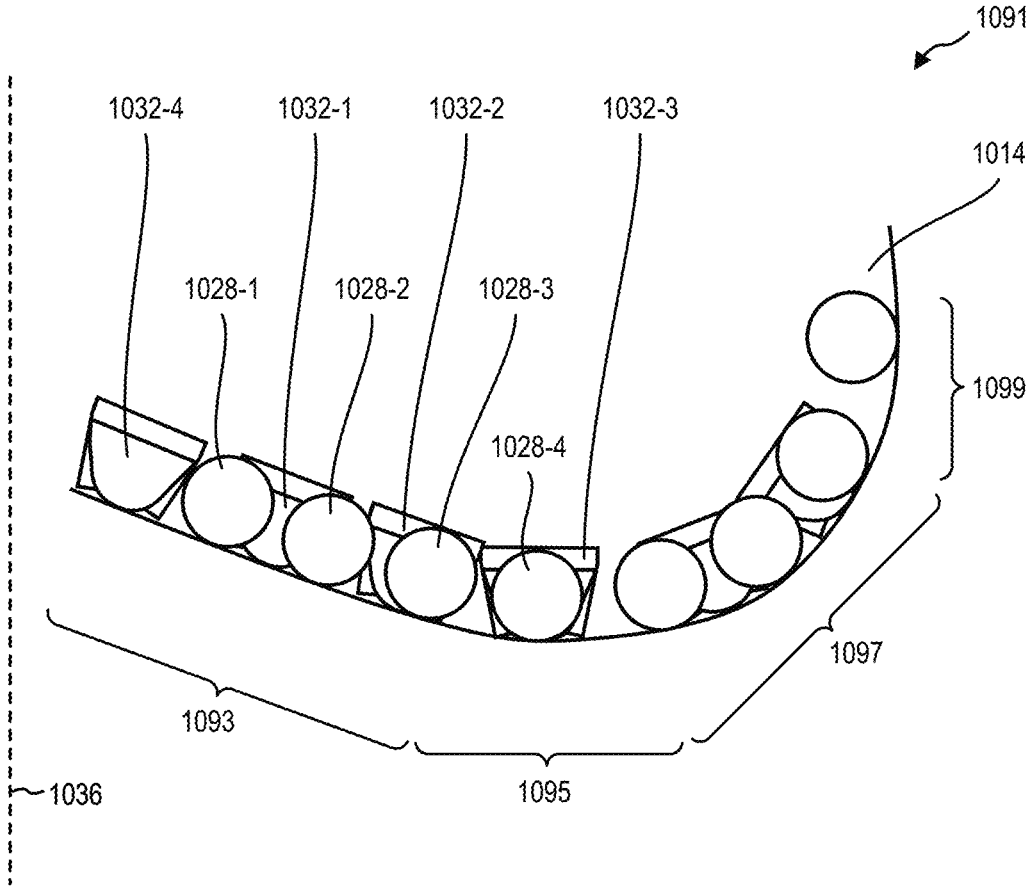
FIG. 10 is a representation of a cutting profile of a blade, according to at least one embodiment of the present disclosure.

FIG. 10 is a representation of a cutting profile 1091 of a blade 1014 of a bit, according to at least one embodiment of the present disclosure. The cutting profile 1091 includes a plurality of primary cutting elements (collectively 1028) and a plurality of faceted cutting elements (collectively 1032) extending along the profile of the blade 1014. The primary cutting elements 1028 may be located on a leading edge of the blade 1014, and the faceted cutting elements 1032 may be secondary cutting elements located rotationally behind the primary cutting elements 1028. In this manner, the faceted cutting elements 1032 may be backup cutting elements to the primary cutting elements 1028.

The blade 1014 includes a cone region 1093, a nose region 1095, a shoulder region 1097, and a gauge region 1099. The primary cutting elements 1028 and the faceted cutting elements 1032 may be located in one or more of the cone region 1093, the nose region 1095, the shoulder region 1097, and the gauge region 1099.

As discussed herein, the faceted cutting elements 1032 may be backup cutting elements and configured to carry a full or a partial cutting load. For example, the faceted cutting elements 1032 may have an exposure that is the same as or approximately the same as the primary cutting elements 1028. In some examples, a first faceted cutting element 1032-1 may be a backup cutting element for one or both of a second primary cutting element 1028-1 and a second cutting element 1028-2. As may be seen, the first faceted cutting element 1032-1 may have the same or approximately the same exposure as the second primary cutting element 1028-1 and the second cutting element 1028-2. The first faceted cutting element 1032-1 may cut the portion of the formation between the second primary cutting element 1028-1 and the second cutting element 1028-2. In this manner, the first faceted cutting element 1032-1 may carry at least a partial cutting load, thereby improving the cutting ability of the blade 1014 of the bit.

In the embodiment, shown, the first faceted cutting element 1032-1 is located centrally between the second primary cutting element 1028-1 and the second cutting element 1028-2. But it should be understood that the faceted cutting elements 1032 may be located at any location rotationally behind the primary cutting elements 1028. For example, a second faceted cutting element 1032-2 may be located primarily behind a third primary cutting element 1028-3, and only partially offset from the third primary cutting element 1028-3. In this manner, the second faceted cutting element 1032-2 may be a cleaning cutting element to at least partially clean the cutting path of the third primary cutting element 1028-3. A third faceted cutting element 1032-3 may be located entirely behind a fourth primary cutting element 1028-4. In this manner, the third faceted cutting element 1032-3 may be a cleaning cutting element to at least partially clean the cutting path of the fourth primary cutting element 1028-4.

In the embodiment shown, a fourth faceted cutting element 1032-4 may be a primary cutting element. For example, the fourth faceted cutting element 1032-4 may not have any be located rotationally behind a primary cutting element 1028. As discussed herein, the fourth faceted cutting element 1032-4 may be installed in a cylindrical cutting element pocket in the cone region 1093 of the blade 1014. The cone region 1093, and in particular, the portion of the cone region 1093 adjacent to a rotational axis 1036 of the bit, may not have room to drill a cutting element pocket in the leading face of the blade 1014. The fourth faceted cutting element 1032-4 may be installed in a cylindrical cutting element pocket, thereby improving the case of assembly of the blade 1014.

As may be seen, the faceted cutting elements 1032 may be used in any portion of the blade 1014. For example, the faceted cutting elements 1032 may be installed in the cone region 1093, the nose region 1095, the shoulder region 1097, and the gauge region 1099.

Figure 11:
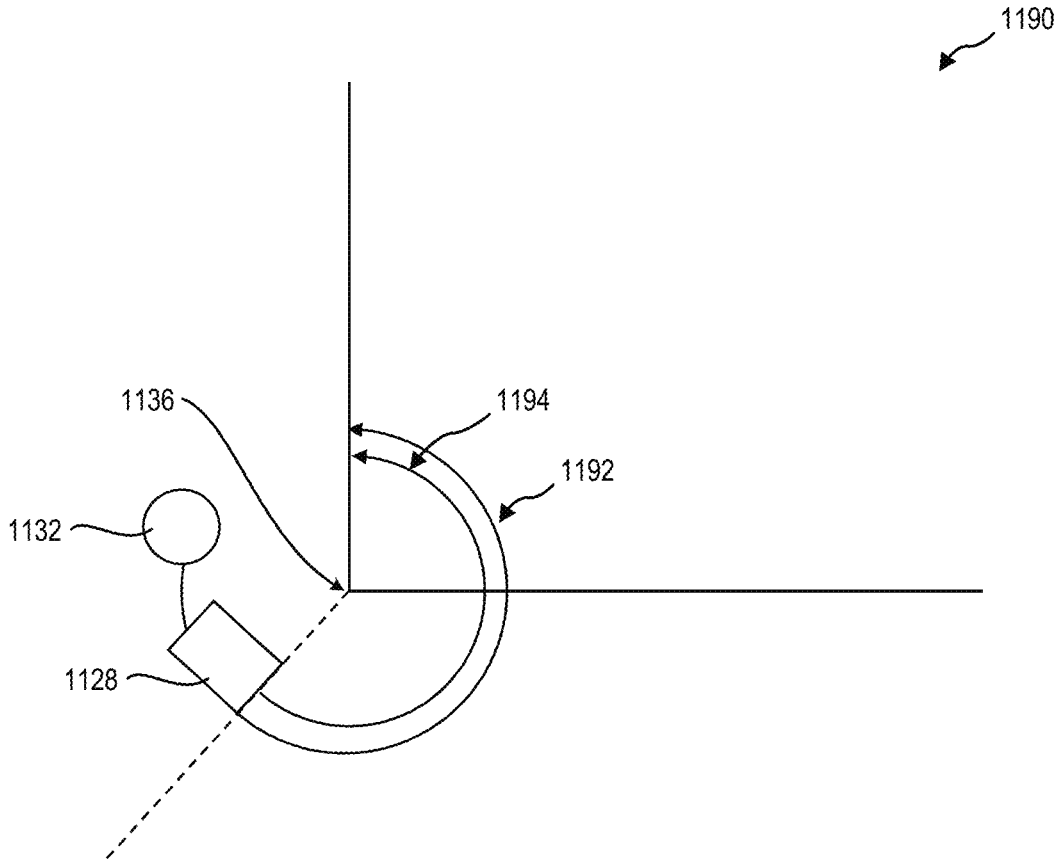
FIG. 11 is a representation of a rotational cutting plot, according to at least one embodiment of the present disclosure.

FIG. 11 is a representation of a rotational cutting plot 1190 including a primary cutting element 1128 and a faceted cutting element 1132 rotating around a bit rotational axis 1136, according to at least one embodiment of the present disclosure. In the embodiment shown in FIG. 11, the faceted cutting element 1132 is located rotationally behind the primary cutting element 1128. The primary cutting element 1128 follows a primary cutting path 1192 and the faceted cutting element 1132 follows a secondary cutting path 1194. The primary cutting path 1192 may be the path that the primary cutting element 1128 follows during rotation of the bit and the secondary cutting path 1194 may be the path that the faceted cutting element 1132 follows during rotation of the bit.

In the embodiment shown, the primary cutting path 1192 has a primary cutting radius that is greater than a secondary cutting radius of the secondary cutting path 1194. This may indicate that the faceted cutting element 1132 may cut a portion of the formation that is located closer to the bit rotational axis 1136 than the primary cutting element 1128. In some embodiments, the primary cutting radius of the primary cutting path 1192 may be the same as the secondary cutting radius of the secondary cutting path 1194. In some embodiments, the primary cutting radius of the primary cutting path 1192 may be less than the secondary cutting radius of the secondary cutting path 1194.

Figure 12:
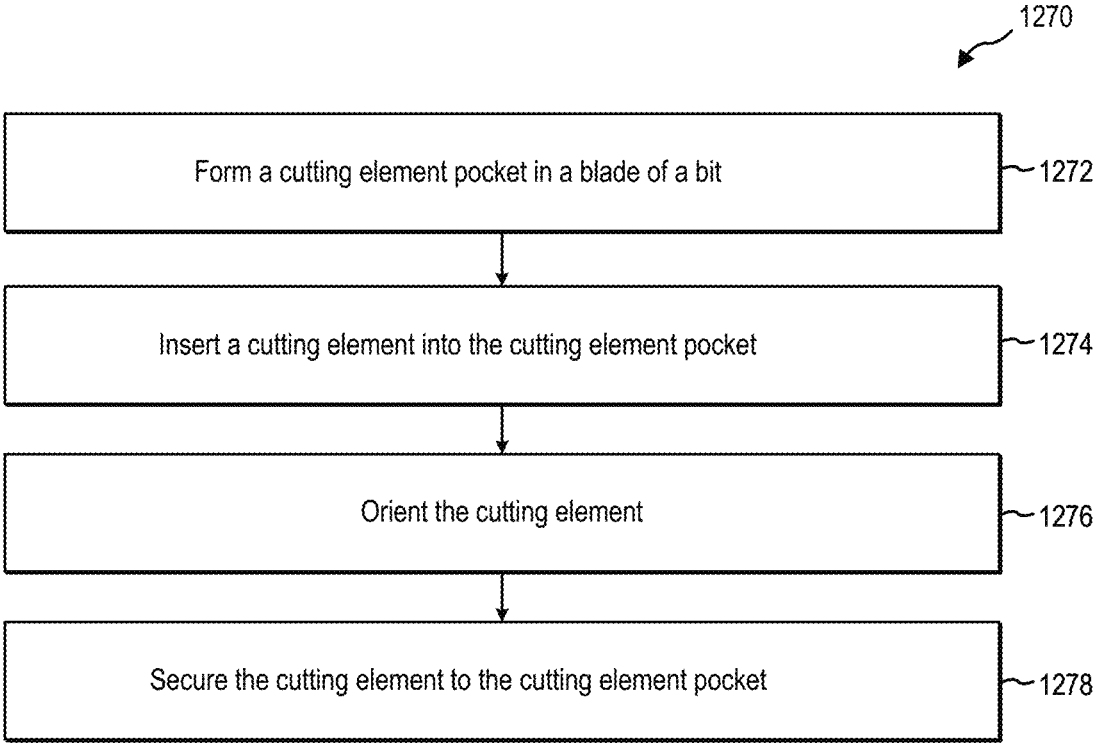
FIG. 12 is a flowchart of a method of manufacturing a bit, according to at least one embodiment of the present disclosure.

FIG. 12, the corresponding text, and the examples provide methods, systems, and devices of a bit manufacturing system. In addition to the foregoing, one or more embodiments can also be described in terms of flowcharts comprising acts for accomplishing a particular result. FIG. 12 may be performed with more or fewer acts. Further, the acts may be performed in differing orders. Additionally, the acts described herein may be repeated or performed in parallel with one another or parallel with different instances of the same or similar acts.

As mentioned, FIG. 12 illustrates a flowchart of a method 1270 or a series of acts for manufacturing a bit in accordance with one or more embodiments. While FIG. 12 illustrates acts according to one embodiment, alternative embodiments may omit, add to, reorder, and/or modify any of the acts shown in FIG. 12. The acts of FIG. 12 can be performed as part of a method.

While manufacturing a bit, an operator may form a faceted cutting element pocket in a blade of a bit at 1272. The faceted cutting element pocket may be machined in the outer surface of the blade of the bit. In some embodiments, the faceted cutting element pocket may be machined perpendicular to the outer surface of the blade of the bit. In some embodiments, the faceted cutting element pocket may be drilled at another angle substantially transverse to the outer surface of the blade of the bit.

As discussed herein, conventionally, a cutting element pocket is milled in a cuboid shape into the outer surface of the blade. To mill the cuboid cutting element pocket, a machine tool may mill into the outer surface of the blade, and the machine tool may be moved laterally to mill out the shape of the cuboid cutting element pocket. This milling process may be time and/or resource intensive, which may increase the cost to manufacture a bit. The cuboid cutting element pocket is drilled to accommodate a cutting element having a cylindrical body with the circumferential face of the body inserted toward a bottom of the cuboid cutting element pocket. As discussed herein, this may result in space in the pocket to be filled by braze or other material, and may decrease the distance between adjacent cutting element pockets. This decreased distance may weaken the body of the blade between adjacent cutting element pockets. This may result in a weak connection between the blade and the cutting element.

In accordance with at least one embodiment of the present disclosure, faceted cutting element pockets may help to increase the strength of the connection between the cutting element and the blade. As discussed herein, the base of the faceted cutting element may be adjacent to the base of the faceted cutting element pocket, with the side surface of the faceted cutting element adjacent the side surface of the faceted cutting element pocket. In this manner, the faceted cutting element may be complementary to the faceted cutting element pocket. This may help to reduce the size of the cutting element pocket and/or increase the distance between adjacent cutting element pockets, resulting in an increased strength of the blade between adjacent cutting element pockets.

In some embodiments, the faceted cutting element pocket may be drilled in a shorter amount of time than a milled cuboid cutting element pocket. This may be because the faceted cutting element pocket may include a single insertion into the outer surface of the blade. For example, the faceted cutting element may not include any milling or removal of material from the blade by the lateral movement of the bit. In this manner, the amount of time used to manufacture the bit may be decreased.

An operator may insert a cutting element into the faceted cutting element pocket at 1274. As discussed herein, the faceted cutting element may be complementary to the cutting element pocket. For example, the base of the faceted cutting element may be cylindrical having a shape and diameter that is the same as or approximately the same as the shape and diameter of the faceted cutting element pocket. The faceted cutting element may include multiple cutting surfaces on a side surface of the cutting element.

The operator may orient the cutting element so that a cutting surface of the plurality of cutting surfaces is oriented at 1276. In some embodiments, one of the cutting surfaces may be oriented in a cutting direction of the bit. For example, the operator may orient the cutting element so that a forward cutting surface may be oriented to face in the forward cutting direction of the bit. In some embodiments, the forward cutting surface may be oriented to face the leading face of the blade. In some embodiments, one or more edge between cutting faces may be oriented in the cutting direction of the bit to cut the formation. In some embodiments, the operator may orient adjacent cutting surfaces to face laterally, such as toward and/or away from the rotational axis of the bit. In some embodiments, the particular cutting surface may have a particular back rake angle, and the back rake angle may be oriented to face rotationally forward. In some embodiments, the particular cutting surface oriented rotationally forward may have a particular exposure relative to the exposure of the primary cutting element. In some embodiments, the operator may secure the faceted cutting element to the faceted cutting element pocket at 1278. For example, the operator may braze the faceted cutting element to the faceted cutting element pocket. In some embodiments, the insertion, securing, and orienting acts of securing the faceted cutting element may occur at substantially the same time. For example, the faceted cutting element may be brazed to the blade of the bit, and the faceted cutting element may be inserted and oriented during the brazing process.

As discussed herein, in some embodiments, the faceted cutting element may be re-oriented. For example, the bit and/or the blade surrounding the faceted cutting element may be heated to above the brazing temperature for the cutting element. This may melt the braze material securing the faceted cutting element to the faceted cutting element pocket. The faceted cutting element may be oriented so that another of the cutting surfaces is facing in the cutting direction of the bit. The cutting element may then be re-secured to the pocket. For example, the bit may be cooled to below the melting temperature of the braze material, causing the braze material to solidify and secure the cutting element the pocket.

The embodiments of the faceted cutting element have been primarily described with reference to wellbore drilling operations; the faceted cutting elements described herein may be used in applications other than the drilling of a wellbore. In other embodiments, faceted cutting elements according to the present disclosure may be used outside a wellbore or other downhole environment used for the exploration or production of natural resources. For instance, faceted cutting elements of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting element, comprising:

a substrate having a base;

an ultrahard layer joined to the substrate opposite the base, the ultrahard layer formed from an ultrahard material, the ultrahard layer including an upper surface recessed into the ultrahard layer toward the base; and a side surface extending between the base and the upper surface, the side surface including a plurality of cutting surfaces arranged one after another in a circumferential direction about a central axis of the cutting element, each cutting surface of the plurality of cutting surfaces facing radially outward from the central axis, each cutting surface of the plurality of cutting surfaces being angled inwardly toward the central axis, and each cutting surface of the plurality of cutting surfaces intersecting adjacent cutting surfaces of the plurality of cutting surfaces in the circumferential direction;

wherein the cutting element further comprises at least one of:

the plurality of cutting surfaces include a first cutting surface having a first relief angle between the upper surface and the first cutting surface, and a second cutting surface having a second relief angle between the upper surface and the second cutting surface, wherein the first relief angle is different than the second cutting surface;

the plurality of cutting surfaces include a first cutting surface having a first cutting surface angle with respect to the central axis of the cutting element, and a second cutting surface having a second cutting surface angle with respect to the central axis, wherein the first cutting surface angle is different from the second cutting surface angle;

a first cutting surface directly adjacent and oriented at an angle relative to a second cutting surface of the plurality of cutting surfaces in the circumferential direction around the central axis of the cutting element, wherein the angle is approximately 90°; or each cutting surface of the plurality of cutting surfaces has a cutting edge that intersects the upper surface, and each cutting edge of the plurality of cutting surfaces is an arcuate cutting edge that curves downward from a peak in opposite circumferential directions toward intersections with cutting edges of adjacent cutting surfaces of the plurality of cutting surfaces.

2. The cutting element of claim 1, wherein the upper surface has a relief angle between the upper surface and a cutting surface of the plurality of cutting surfaces, the relief angle between 80° and 110°.

3. The cutting element of claim 1, wherein each cutting surface of the plurality of cutting surfaces has the cutting edge that intersects the upper surface, and each cutting edge of the plurality of cutting surfaces is the arcuate cutting edge that curves downward from the peak in the opposite circumferential directions toward the intersections with the cutting edges of the adjacent cutting surfaces of the plurality of cutting surfaces.

4. The cutting element of claim 3, wherein the upper surface extends inwardly from each cutting edge of the plurality of cutting surfaces such that the upper surface extends radially inward toward the central axis and axially inward toward the base, the plurality of cutting surfaces includes only four cutting surfaces in the circumferential direction around the side surface, the cutting edge of each of the four cutting surfaces is the arcuate cutting edge that curves downward from the peak in the opposite circumferential directions toward the intersections with the cutting edges of the adjacent cutting surfaces of the plurality of cutting surfaces, the cutting element has a cylindrical side wall extending upward from the base toward the four cutting surfaces, and the cylindrical side wall is configured to mount in a cylindrical pocket in a body of a drill bit.

5. The cutting element of claim 1, wherein the plurality of cutting surfaces include:

the first cutting surface having the first relief angle between the upper surface and the first cutting surface; and the second cutting surface having the second relief angle between the upper surface and the second cutting surface, the first relief angle different than the second cutting surface.

6. The cutting element of claim 1, wherein the plurality of cutting surfaces include:

the first cutting surface having the first cutting surface angle with respect to the central axis of the cutting element; and the second cutting surface having the second cutting surface angle with respect to the central axis, the first cutting surface angle different from the second cutting surface angle.

7. The cutting element of claim 1, wherein the first cutting surface is directly adjacent and oriented at the angle relative to the second cutting surface of the plurality of cutting surfaces in the circumferential direction around the central axis of the cutting element, wherein the angle is approximately 90°.

8. A bit having the cutting element of claim 1, wherein the bit comprises:

a body;

a blade connected to the body, the blade including a cutting element pocket having a pocket base; and the cutting element secured to the body in the cutting element pocket.

9. A bit, comprising:

a body;

a blade connected to the body, the blade including a cutting element pocket having a pocket base; and a cutting element secured to the body in the cutting element pocket, the cutting element including:

a substrate inserted into the cutting element pocket;

an ultrahard layer;

a plurality of cutting surfaces arranged one after another in a circumferential direction about a central axis of the cutting element, each cutting surface of the plurality of cutting surfaces facing radially outward from the central axis, each cutting surface of the plurality of cutting surfaces being angled inwardly toward the central axis, and each cutting surface of the plurality of cutting surfaces intersecting adjacent cutting surfaces of the plurality of cutting surfaces in the circumferential direction, wherein the plurality of cutting surfaces includes:

a first cutting surface oriented approximately parallel to a leading surface of the blade in a direction of rotation of the bit about a rotational axis;

a second cutting surface angled away from the first cutting surface and away from the direction of rotation, wherein the second cutting surface faces radially inward toward the rotational axis of the bit; and a third cutting surface angled away from the first cutting surface and away from the direction of rotation, wherein the third cutting surface faces radially outward away from the rotational axis of the bit; and an upper surface recessed into the cutting element.

10. The bit of claim 9, further comprising a primary cutting element secured to a leading surface of the blade, wherein the cutting element is a secondary cutting element located rotationally behind the primary cutting element on the blade in a direction of rotation of the bit, and the cutting element pocket is a cylindrical pocket.

11. The bit of claim 10, wherein the primary cutting element has a primary rake angle and a primary exposure and the secondary cutting element has a secondary rake angle and a secondary exposure, wherein the primary rake angle is the same as the secondary rake angle, the secondary exposure is less than the primary exposure, or a combination thereof.

12. The bit of claim 9, wherein each cutting surface of the plurality of cutting surfaces has a cutting edge that intersects the upper surface.

13. The bit of claim 12, wherein the cutting edge of each cutting surface of the plurality of cutting surfaces is an arcuate cutting edge that curves downward from a peak in opposite circumferential directions toward intersections with cutting edges of adjacent cutting surfaces of the plurality of cutting surfaces.

14. The bit of claim 13, wherein the upper surface extends inwardly from each arcuate cutting edge of the plurality of cutting surfaces such that the upper surface extends radially inward toward the central axis and axially inward toward a base of the substrate.

15. The bit of claim 9, wherein the cutting element is in the cutting element pocket in a cone region of the blade.

16. The bit of claim 9, wherein no portion of the ultrahard layer is located in the cutting element pocket.

17. A method for manufacturing a bit, comprising:

forming a cutting element pocket in a blade of a bit;

inserting a cutting element into the cutting element pocket, the cutting element complementary to the cutting element pocket, a side surface of the cutting element including a plurality of cutting surfaces arranged one after another in a circumferential direction about a central axis of the cutting element, each cutting surface of the plurality of cutting surfaces facing radially outward from the central axis, each cutting surface of the plurality of cutting surfaces being angled inwardly toward the central axis, each cutting surface of the plurality of cutting surfaces intersecting adjacent cutting surfaces of the plurality of cutting surfaces in the circumferential direction, each cutting surface of the plurality of cutting surfaces having a cutting edge that intersects an upper surface, and the cutting edge of each cutting surface of the plurality of cutting surfaces is an arcuate cutting edge that varies in an axial distance from a base of the cutting element in opposite circumferential directions toward intersections with cutting edges of adjacent cutting surfaces of the plurality of cutting surfaces;

orienting the cutting element so that one of the plurality of cutting surfaces is oriented in a cutting direction of the bit; and securing the cutting element to the cutting element pocket.

18. The method of claim 17, wherein securing the cutting element includes brazing the cutting element to the cutting element pocket, and further comprising:

after brazing the cutting element, melting braze material between the cutting element and the cutting element pocket;

after melting the braze material, orienting the cutting element so that another of the plurality of cutting surfaces is oriented in the cutting direction of the bit; and after orienting the cutting element, securing the cutting element to the cutting element pocket.

19. The method of claim 17, wherein forming the cutting element pocket in the blade of the bit includes drilling the cutting element pocket in an outer surface of the blade of the bit, wherein the cutting element pocket comprises a cylindrical pocket, and the plurality of cutting surfaces include first, second, third, and fourth cutting surfaces arranged one after another in the circumferential direction about the central axis of the cutting element.

* * * * *